US011730189B2

(12) United States Patent
Szarvas

(10) Patent No.: US 11,730,189 B2
(45) Date of Patent: Aug. 22, 2023

(54) CIGARETTE FILTER CONTAINING ALGINITE

(71) Applicant: Optifilter Research Zrt., Pécs (HU)

(72) Inventor: Tibor Szarvas, Budapest (HU)

(73) Assignee: OPTIFILTER RESEARCH ZRT., Pécs (HU)

( * ) Notice: Subject to any disclaimer, the term of this patent is extended or adjusted under 35 U.S.C. 154(b) by 211 days.

(21) Appl. No.: 17/239,820

(22) Filed: Apr. 26, 2021

(65) Prior Publication Data

US 2021/0315269 A1 Oct. 14, 2021

Related U.S. Application Data

(62) Division of application No. 16/096,347, filed as application No. PCT/HU2016/000023 on Apr. 25, 2016, now abandoned.

(51) Int. Cl.

| | |
|---|---|
| ***A24D 3/16*** | (2006.01) |
| ***A24D 3/14*** | (2006.01) |
| ***A24D 3/06*** | (2006.01) |
| ***A24D 1/04*** | (2006.01) |

(52) U.S. Cl.

CPC ..... *A24D 3/163* (2013.01); *A24D 1/045* (2013.01); *A24D 3/06* (2013.01); *A24D 3/067* (2013.01); *A24D 3/14* (2013.01); *A24D 3/16* (2013.01)

(58) Field of Classification Search

CPC ..... A24D 3/163; A24D 1/045; A24D 3/06; A24D 3/14

See application file for complete search history.

(56) References Cited

U.S. PATENT DOCUMENTS

| | | | |
|---|---|---|---|
| 2,794,239 | A | 6/1957 | Crawford et al. |
| 2,953,838 | A | 9/1960 | Crawford et al. |
| 5,387,285 | A | 2/1995 | Rivers |
| 2003/0168071 | A1 | 9/2003 | Han |

(Continued)

FOREIGN PATENT DOCUMENTS

| | | |
|---|---|---|
| HU | 189383 B | 6/1986 |
| JP | 07-075542 | 8/1995 |

(Continued)

OTHER PUBLICATIONS

Ambrose et al., "The pathophysiology of cigarette and cardiovascular disease. An update",Journal of the American College of Cardiology, vol. 43, 2004, pp. 1731-1737.

(Continued)

*Primary Examiner* — Kelly M Gambetta
*Assistant Examiner* — Jennifer A Kessie
(74) *Attorney, Agent, or Firm* — Faegre Drinker Biddle & Reath LLP

(57) ABSTRACT

The invention relates to a cigarette filter. In particular, the present invention relates to a new cigarette filter, in which materials of natural origin are used that have not been applied in this special field before. More particularly, the present invention relates to a cigarette filter, which can be used for absorbing the toxic components of cigarette smoke, and lowering the tissue damage triggered by cigarette smoke on the respiratory organs, the cardiovascular system and the mucosa. Especially the present invention relates to a cigarette filter containing alginate.

17 Claims, 15 Drawing Sheets

(56) References Cited

U.S. PATENT DOCUMENTS

| | | | | |
|---|---|---|---|---|
| 2008/0295853 | A1* | 12/2008 | Jones | A24D 3/163 131/343 |
| 2017/0031051 | A1* | 2/2017 | Song | G01R 33/4641 |
| 2019/0281888 | A1 | 9/2019 | Szarvas | |

FOREIGN PATENT DOCUMENTS

| | | | |
|---|---|---|---|
| JP | 08-322539 | A | 12/1996 |
| JP | 3677309 | B2 | 7/2005 |
| WO | 2010/125412 | A1 | 11/2010 |
| WO | 2013/186938 | A1 | 12/2013 |
| WO | 2014/164492 | A1 | 10/2014 |

OTHER PUBLICATIONS

Chen et al., "Autophagy protein microtubule-associated protein 1 light chain-3B (LC3B) activates extrinsic apoptosis during cigarette smoke-induced emphysema". Proc Natl Acad Sci USA, vol. 107, No. 44, Nov. 2, 2010, pp. 18880-18885.

Church et al., "Freeradical chemistry of cigarette smoke and its toxicological implications," Environ Health Perspect, vol. 64, 1985, pp. 111-126.

International Preliminary Reporton Patentability received for PCT Patent Application No. PCT/HU2016/000023, dated Jan. 22, 2019, 5 pages.

International Search Report and Written Opinion received for PCT Patent Application No. PCT/HU2016/000023, dated Oct. 8, 2018, 8 pages.

Kosmider et al., "Human alveolar epithelial cell injury induced by cigarette smoke", PLoS One, vol. 6, 2011, e26059, pp. 1-11-.

Messneret al , "Smoking and cardiovascular disease. Mechanisms of endothelial dysfunction and early atherogenesis", Arterioscler Thromb Vase Biol, vol. 34, 2014, pp. 509-515.

Rahman et al., "Oxidative stress and regulation of glutathione in lung inflammation", Eur Respir J, vol. 16, 2000, pp. 534-554.

* cited by examiner

Effect of filter composition on the smoke induced cell death in A 549 human lung epithelial cell line

Smoke MTT 2015 09 03

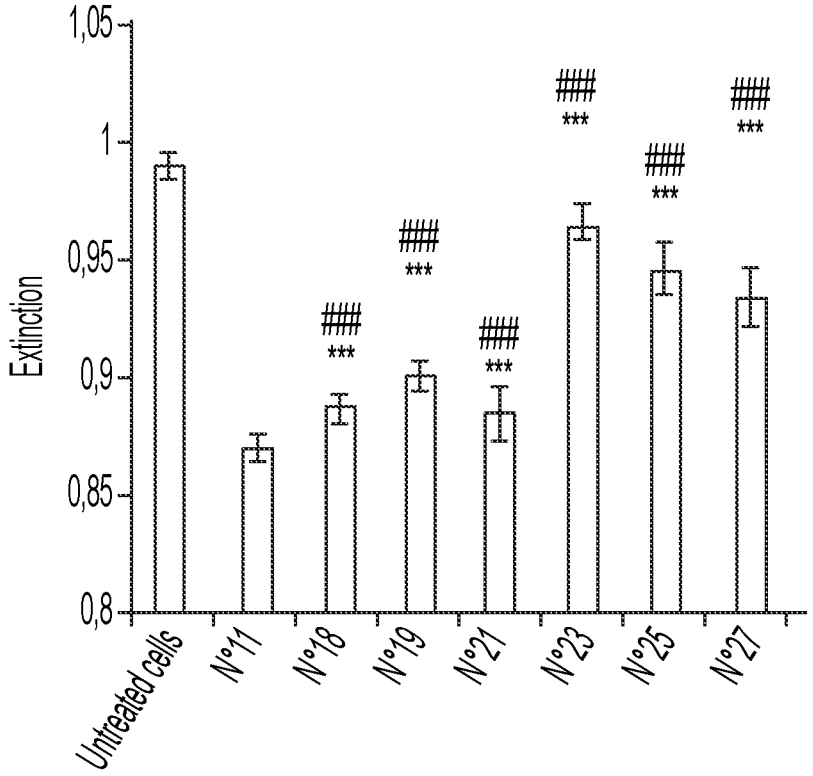

*** p<0,001 compared to N°11 (control filter)

p<0,001 compared to untreated cells

Cells: A549 $5x10^3$ cells / well,
Untreated are 64 replicates, the others are 32 replicates

| | |
|---|---|
| No 11: Control | KRC |
| No 18: Carbon mono rod 10mm | CelRod-10-C |
| No 19: Alginite mono rod 10mm | CelRod-10-A |
| No 21: Zeolite mono rod 10mm | CelRod-10-Z |
| No 23: Alginite / GSSG rod 50-50% 10mm | CelRod-10-AG |
| No 25: Carbon / Alginite rod 50-50% 10 mm | CelRod-10-CA |
| No 27: GSSG 5mm / Zeolite 5mm / Alginite 5mm | CelRod-15-GZA |

FIG. 12

CIGARETTE FILTER CONTAINING ALGINITE

RELATED APPLICATIONS

The present application is a divisional of U.S. application Ser. No. 16/096,347, filed Apr. 26, 2016, which is a national phase filing under 35 U.S.C. § 371 of International Application No. PCT/HU2016/000023, titled "NEW CIGARETTE FILTER CONTAINING ALGINITE," filed on Apr. 25, 2016, the entire disclosures of which being expressly incorporated herein by reference

FIELD OF THE INVENTION

The present invention relates to a cigarette filter. In particular, the present invention relates to a new cigarette filter, in which materials of natural origin are used that have not been applied in this special field before. More particularly, the present invention relates to a cigarette filter, which can be used for adsorbing the toxic components of cigarette smoke, and lowering the tissue damage triggered by cigarette smoke on the respiratory organs, the cardiovascular system and the mucosa. Especially the present invention relates to a cigarette filter containing alginite.

TECHNICAL BACKGROUND

Tobacco smoking is a widespread, harmful human habit, which is known to cause serious and often irreversible health damage. Currently, smoking is one of the most highly documented etiological factors contributing to the development of lung cancer and chronic obstructive pulmonary disease (COPD). Health damage caused by smoking generates serious social and financial problems worldwide. For example, in the EU countries alone premature death of more than 500.000 people is caused by the harmful effects of smoking.

About 50 years ago, the office of the U.S. Surgeon General issued its first report on smoking and health (U.S. Department of Health, Education and Welfare, 1964). This report estimated that the average smoker had a 9-10-fold chance of developing lung cancer compared to a non-smoker, whereas heavy smokers had an increased risk of about 20-fold. In addition, the report pointed out that smoking was the primary cause of chronic bronchitis and that there was an association between smoking and emphysema as well as with cardiovascular disease. It should be noted that chronic bronchitis and emphysema are now considered as two aspects of chronic obstructive lung disease (COPD). In the past 50 years, the U.S. Surgeon General's office has issued numerous reports on smoking and health, some dealing with specialized topics, such as smoking cessation, smoking during pregnancy, and environmental tobacco smoke. The most recent report was issued in 2014—exactly 50 years after the first report (U.S. Department of Health and Human Services, 2014).

In the past 50 years, the list of diseases associated with smoking has expanded considerably. Focusing only on cancer, there are now numerous types of cancers associated with smoking in addition to lung cancer, including upper respiratory tract cancers (oropharynx, pharynx, trachea, and bronchus), stomach cancer, liver cancer, kidney cancer, pancreatic cancer, bladder cancer, cervical cancer, colorectal cancer, and acute myeloid leukemia. Moreover, the U.S. Surgeon General indicates that perhaps as many as many as 20 million Americans have died prematurely during the past 50 years because of the effect of smoking. Given the obvious deleterious effects of smoking, mitigation of these effects is an enormous health problem, and any measures that can be taken to reduce the problem are clearly worthwhile investigating. Without doubt, the best action is to stop smoking. The benefits of smoking cessation are well known (see, for example, Fagerstrom, 2002). However, there are many smokers who either choose not to quit or who find it too difficult to quit. Although quitting smoking would be the most effective measure, the use of new technology, such as novel filters that effectively remove harmful smoke constituents could significantly reduce tobacco-related disease. As a consequence, any measures that can be taken to reduce the health effects of smoking will have a significant benefit. Without question, the most obvious attempt to mitigate the health effects of smoking through modification of the cigarette is through the addition of a cigarette filter. However, the use of filters has not been particularly successful.

One of the earliest proposals to add a filter to cigarettes was undoubtedly made by Ernst Wynder, an epidemiologist who was one of the first scientists to demonstrate the association of cigarette smoking with lung cancer. An early study co-authored by Wynder published in 1988 assessed the difference in lung cancer risk between filtered cigarette smokers and non-filtered cigarette smokers (Wynder and Kabat, 1988). This study looked at the difference between these two types of smokers with respect to Kreyberg I (KI) and Kreyberg II (KII) cancers. (The Kreyberg nomenclature was in effect at that time, with KI lung cancers including squamous cell lung carcinoma, large cell lung cancer, and small cell lung cancer, whereas KR lung cancers comprising only lung adenocarcinoma.) A reduction of about 45-50% was found for both men and women with respect to KI tumors, although neither was statistically significant, while only a weaker difference was observed in men and no difference in women for KII tumors. Cigarette filters became extremely popular during the second half of the $20^{th}$ century, with approximately 0.5% of cigarettes sold with filters in 1950 increasing to 88.5% in 1976 in the US (National Institute on Drug Abuse, 1977). Currently close to 100% of cigarettes sold worldwide are filter cigarettes. During the same period of time when filter use was rising at a rapid rate in the US (19501976), machine measured sales-weighted cigarette tar deliveries decreased from 37 mg to 16 mg (Hoffmann D et al., 1996). Decrease in tar delivery over this period was a consequence of two trends. The first, as noted above, was simply a rapid increase in the use of filtered cigarettes. The second, however, was a consequence of increasing efficiencies of filters over time. A cigarette filter is conceptually quite simple, consisting of a porous plug of a given material that can absorb both cigarette tar and gas phase. Although some early filters used paper fibers as the absorbing material, currently the vast majority of filters use cellulose acetate fibers. The filter, therefore, is simply a paper tube filled with cellulose acetate that is attached to the cigarette by using an overwrap. Increasing efficiency can be attained both by increasing the mass of cellulose acetate in the filter and by decreasing the filament diameter. Both of these approaches can only be taken so far, however, because eventually the resistance to draw of the cigarette becomes sufficiently large that the product is unacceptable to the consumer. The approach adopted by virtually all tobacco companies to solve this problem was to introduce perforations in the filter overwrap. Thus the smoker inhales a mixture of air and smoke. The ventilation holes reduce the resistance to draw, and by taking in air as well as smoke, the smoke is diluted and the delivery of smoke constituents is reduced. The greater the extent of ventilation, the greater the amount of air and the lesser amount smoke that is inhaled by the smoker. Although most experts agree that a filtered cigarette reduces the risk of smoking at least to some extent compared to a non-filtered cigarette, low tar cigarettes, as they were called, that reduced tar delivery even lower than could be achieved by a normal cigarette filter did not appear to lead to a health benefit. This conclusion was based on both population data and epidemiological studies. Considerable data were presented documenting the fact that smokers significantly compensate when smoking a "low tar cigarette" either to maintain the level of nicotine or the level of taste, thus increasing the actual delivery of smoke above the machine-measured yield. In addition, a number of scientists expressed concern that the smoker could deliberately or inadvertently block the ventilation holes, thus also significantly increasing smoke delivery (U.S. Department of Health and Human Services, 2001). One tangible result of these concerns is that cigarette packs are no longer allowed to state the machine-measured tar and nicotine yields in at least the U.S. and the E.U. Despite these issues, it may still be possible to develop novel filters that can reduce the health effects of smoking, particularly if such filters can be developed without the need for filter ventilation. Such filters could be designed to selectively remove specific gas phase and semi-volatile smoke components of concern. It is important to note that smoke consists of gas phase, semi-volatiles, and particulate phase. Constituents for which evidence exists with respect to health effects can be found in all three phases. No current technology exists that allows selective filtration of particulate phase components; however, both gas phase and semi-volatile components can be selectively filtered. An excellent example of such a filter currently in commercial use is the carbon filter. Virtually the entire Japanese market consists of carbon-filtered cigarettes, while about 50% of South Korean smokers use these products. A number of other technological advances have been made in developing filters, but none of these is currently in significant commercial use. Currently the filter is a segment integrated directly into the cigarette at the mouth end, so that cigarette smoke must pass through the filter before entering the airways and lungs. Currently only 3% of all cigarettes in the world are sold without filter. Although the amount of harmful substances reaching the smoker can be reduced by cigarette filters, this is generally accomplished by simply reducing the amount of smoke that reaches the mouth end of the cigarette. In most cases there is little to no selective filtration. Thus, researchers are highly interested in constructing a cigarette filter, which can selectively remove certain hazardous smoke constituents in order to reduce the health consequences of smoking.

Cigarette smoke contains many reactive particles such as low molecular weight carbonyl compounds, free radicals, quinones, hydrogen cyanide, nitrogen oxides, and aromatic amines, which are highly toxic, mutagenic and carcinogenic. Therefore, selectively lowering the amount of these substances in cigarette smoke may reduce the health risks caused by smoking.

Increasingly, governmental regulations require higher filtration efficiencies to reduce the amount of tobacco smoke delivered to the smoker. Using the presently available cellulose acetate filters, some selectivity can be achieved by doping the filter with increasing concentrations of particles like activated carbon or other natural occurring substances. However, increasing particulate concentration changes draw characteristics for smokers. Moreso, active carbon particles in the filter contribute to lower the amount of harmful volatile substances in cigarette smoke but because the lack of unpaired electrons they cannot provide the required plus electron to complement the unpaired electrons of the free radicals. Therefore, carbon is not suitable to counter the free radical impact on various tissues, which contribute to inflammation and other harmful processes in the body triggered by cigarette smoke.

One important property of a cigarette is the encapsulated pressure drop. The term "encapsulated pressure drop" or "EPD" refers to the static pressure difference between the two ends of a cigarette when it is traversed by an air flow under steady conditions. Higher EPD values translate to the smoker having to draw on a smoking device with greater force.

Because increasing conventional filter efficiency increases the EPD of the filters, the public, and consequently manufactures, have been slow to adopt these products. Therefore, there remains an interest in developing improved and more effective filters that minimally effect draw characteristics of cigarettes while removing higher levels of certain constituents in mainstream tobacco smoke such as the constituents noted above as well as carbon monoxide and phenols.

The most commonly filler used in cigarette filter manufacture is cellulose acetate that has a degree of substitution of about 2.5 acetate groups per anhydroglucose unit. During manufacture, the acetate polymer typically is extruded as a fiber tow and mixed with one or more plasticizers (e.g., triacetin, polyethylene glycol, glycerin). Cellulose acetate tow processes are described, for example, in U.S. Pat. No. 2,953,838 to Crawford et al. and U.S. Pat. No. 2,794,239 to Crawford et al. Various fluids may be injected into the multifilament fiber tow used in the manufacture of tobacco smoke filters. These fluids, which may be used in the tow alone or in combination with liquid or gaseous carriers, may be flavorants, tow blooming agents, lubricants, sizing solutions, finish compositions, plasticizers, or the like. Such fluids are intended to impart desired physical or flavor characteristics to the cigarette smoke via the fluid-treated tow. Fluid injection processes are set forth, for example, in U.S. Pat. No. 5,387,285 to Rivers.

The cellulose acetate fibers that form the filter element typically are coated with a fiber finish composition. Such compositions are generally water based emulsions comprised of multiple components. Each component may serve a specific function either during processing of the fibers or during subsequent use of a filter formed from the fibers. Typical components of a fiber finish composition include lubricating oils to reduce friction so that the fibers can be processed without breakage, anti-static agents to reduce static build-up on the fibers, and emulsifiers to inhibit phase separation in a fiber formulation during processing. Other auxiliary components may include anti-microbial agents, hydrophilic agents, or other reactive compounds. After assembly of fibrous tow into filter-ready material, plasticizers may be applied to soften the fiber and to enable inter-fiber bonds to form to harden the filter to a desired hardness/consistency. The surface chemistry of cellulose acetate and plasticizer may provide for a smoke flavor that is widely desired and accepted by smokers. Certain other filter designs/formulations may provide a different smoke flavor. To date, non-cellulose acetate tow filters have not generally been accepted nor met with commercial success.

The state of art contains several publications relating to cigarette filters and various improvements applied thereto.

W02013/1869838 discloses a cigarette filter comprising a filter plug containing a cellulose ester staple fiber, a pulp, and an alkali metal salt of a water-soluble anionic polymer. The filter plug has an alkali metal content of 2 to 100 μmol per gram of the filter plug. The water-soluble anionic polymer may comprise at least one member selected from the group consisting of a polyacrylic acid and a polysaccharide having a carboxyl group.

Japanese Patent No. 3677309 discloses a cigarette filter material in the form of a sheet having a paper structure and comprising an uncrimped cellulose ester staple fiber and a beaten pulp, wherein the beaten pulp has a degree of beating of Schopper-Riegler freeness of 20 to 90° SR, and the uncrimped cellulose ester staple fiber is a staple fiber having an average fiber length of 1 to 10 mm and a fineness of 1 to 10 deniers. This document discloses that in the preparation of the sheet material there a binder (for example, a water-soluble adhesive) a binder may be employed provided that it does not have negative health effects, nor decreases the taste and palatability of tobacco smoke, nor can lead to the disintegration of the filter material. In general the amount of the binder is preferably as small as possible (for example, not more than 10% by weight in the total weight of the material). An Example in this document describes a sheet material formed from an uncrimped cellulose acetate staple fiber and a beaten pulp by wet paper production process, which was then sprayed with an aqueous solution of a carboxymethyl cellulose (3% by weight on a dry weight basis).

Japanese Patent Application with Publication No. 7-75542 discloses a cigarette filter comprising a tow of a cellulose ester fiber and a water-soluble polymer that is contained in the tow and bonds the fiber, the tow having been processed into a filter rod using not more than 25 parts by weight of water with respect to 100 parts by weight of the tow. Examples in this document include a cigarette filter tip is obtained by adding 5% by weight of a carboxymethyl cellulose sodium salt as a water-soluble polymer to an opened cellulose acetate crimped fiber tow and feeding the opened tow to a wrapping machine to wrap the opened tow with a filter wrap.

Japanese Patent Application with Publication No. 8-322539 (Patent Document 3, JP-8322539A) discloses a cigarette filter comprising a nonwoven fabric consisting of a cellulose ester composition and a binder having a good water-dispersibility, the nonwoven fabric being wrapped up into a rod form. Examples in this document include a filter plug produced by blowing a screen wire with a cellulose acetate staple fiber by air flow for lamination or deposition, and spraying the laminate matter on the wire with 10% by weight of a 5% aqueous solution of a carboxymethyl cellulose, pressing and drying the wet laminate, subjecting the resulting nonwoven fabric to crepe roll treatment, and then wrapping the fabric.

International Publication No. WO 2014/164492 relates to smoke filters that reduce the concentration of carbon monoxide and phenols in a smoke stream. Said filters include a porous mass section comprising a plurality of active particles, a plurality of binder particles, and an active coating disposed on at least a portion of the active particles and the binder particles, wherein the active particles and the binder particles are bound together at a plurality of contact points; and a filter section. In some instances, a filter may include a porous mass section comprising a plurality of active particles and a plurality of binder partides, wherein the active particles and the binder particles are bound together at a plurality of contact points without an adhesive; and a filter section comprising an active dopant. Although this smoke filter may deliver enhanced results, its preparation is rather complicated and the materials used for achieving the desired filtering effect are expensive.

A highly efficient cigarette filter is described in WO 2010/125412. The cigarette filter comprises in addition to the common components of the cigarette filters pseudoboehmite ($AlOOH.H_2O$), and grape components, astaxanthin and cranberry as antioxidant. The advantageous effect of the cigarette filter is also due to the use of the grape components in grape pip and skin grist form. WO 2010/125412 is herewith incorporated in its whole content as a reference.

As was mentioned above, it is well known that smoking is a major public health issue and an important etiological factor contributing to the development of lung cancer and chronic obstructive pulmonary disease. Therefore, identifying new techniques to reduce cigarette induced lung disease would be of considerable benefit.

Accordingly, the aim of the present invention is to provide a cigarette filter, which has the advantages of solutions already belonging to the state of the art, but at the same time eliminates their drawbacks to the best extent possible. A further aim of the present invention is to provide a cigarette filter which further reduces the harmful content of the cigarette smoke compared to known cigarette filters.

Surprisingly it was found that the aims of the invention can be successfully achieved, if a natural substance, alginite, not used before for this purpose, is applied in the cigarette filter.

Our experiments showed that a significant reduction of the amount of harmful substances in cigarette smoke, compared to current filters, can be realized if alginite is used in the filters.

BRIEF DESCRIPTION OF THE FIGURES

FIG. 12 is a diagram illustrating the effect of different filter compositions relative to smoke-induced death of A549 epithelial cells;

DETAILED DESCRIPTION OF THE INVENTION

Figure 1:
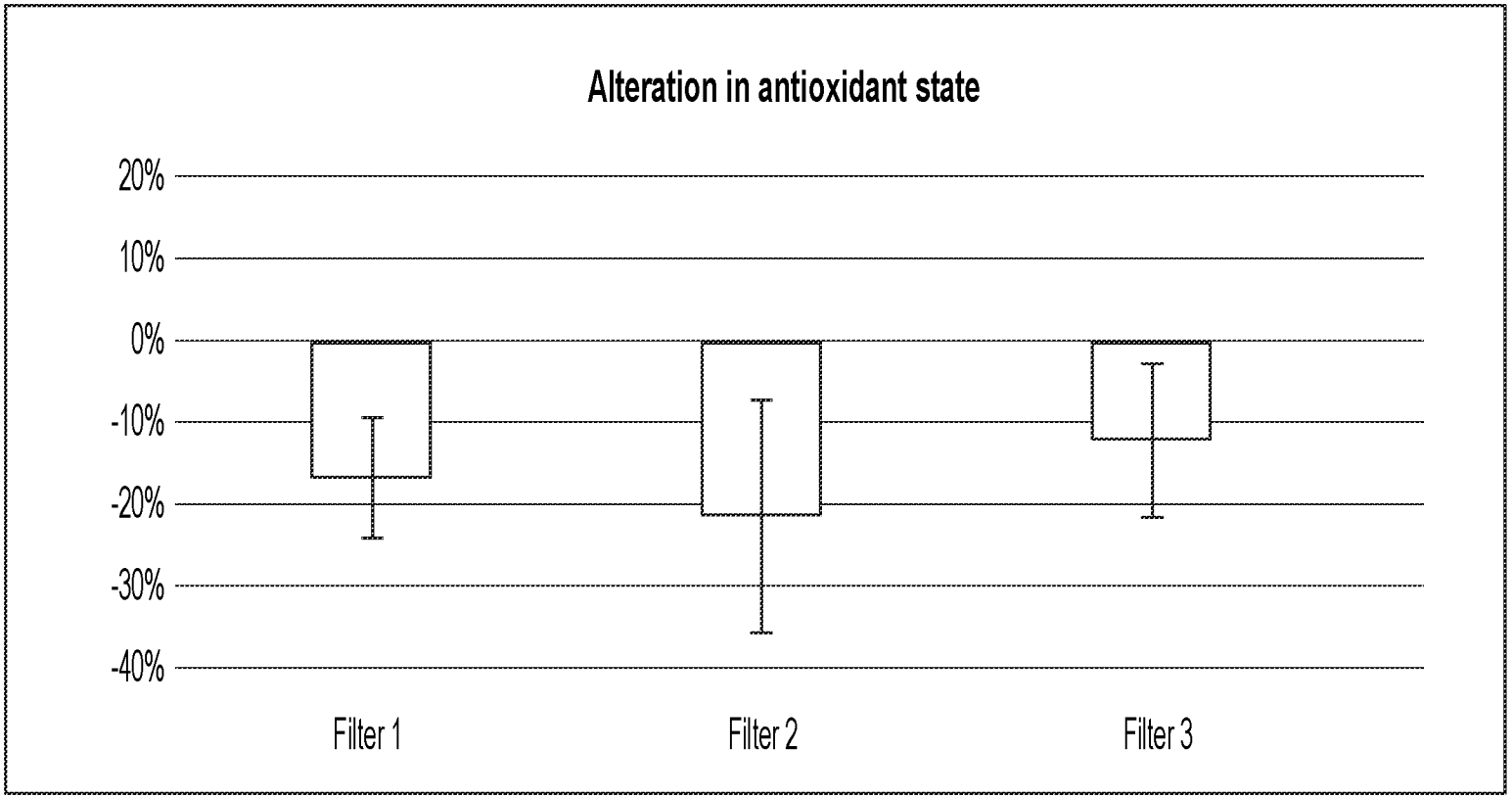
FIG. 1 is a diagram illustrating the effect of different filter compositions on A.0 cell death in A549 cells.

The present invention relates to a cigarette filter, which further reduces the harmful content of the cigarette smoke compared to known cigarette filters. Said advantageous properties are due to the use of alginite in the cigarette filters. Alginite can be used alone or in combination with other substances, already used in cigarette filters.

Alginite is a precipitated rock consisting of alga biomass and tufa, volcanic dust disaggregated to clay. In the lakes of the Carpathian basin intensive volcanic activity occurred in the Pliocene some 3-5 million years ago. This activity created the well-known basalt mountains, at the same time forming special tufa rings as well. After extinction of the volcanic activity the tufa rings were flooded by water thereby forming explosion lakes (maars). The water of the explosion lakes was heated by thermal springs, and the hot solutions comprised therein enriched the water with microelements, mineral salts and other nutritives. The elements in the mineral colloids resulting from the degradation of the glass material of the volcanic tufa further enriched the nutritive content of the explosion lakes. In the calm waters of the explosion lakes large amounts algae (especially the green alga *Botriococcus braunii*) and other floating animal or plant organisms accumulated. The accumulated plant and animal organisms died and mixed with the residues of the leaves and anther-dust washed from the dense shore vegetation and deposited on the bottom of the explosion lakes. In the anoxic environment together with the disintegrated tufa and other dead planktonic organisms they accumulated as decaying (sapropel) mud. In the siltation phase of the explosion lakes the bodies of bigger animals were introduced into the warm mud, and as a result the mud was enriched in phosphorous materials. This depleted and hardened biomass underwent specific physical and chemical changes during several millions of years and formed into its present form: the rock alginite.

Alginite is an earthy rock having clay structure consisting of occasionally leaf-like detaching lamellas. Alginite has no toxic effect (see Dr. Solti Gabor: Az Alginit. Ismertetö tanulmány. Az Alginit a Mezögazdaságért és Környezetvédelemért Alapitvány tevékenysége (1993-2013) 2014). Its color is reseda (green) or grey sometimes turning into ochreous. Its lamella structure can be better seen upon desiccation, and frequently plant imprints or plant residues can be found between lamellas.

Its most important physical property is that it can bind 0.5-1.01 water per kilogram. Alginite consists of 80-90% clay and silt fractions, with the deposition containing the coarser particles near the shore. In the last phase of the siltation craters (lagoons) the organic material content decreased and the bentonite content increased. The composition of alginite shows high deviation in samples taken from the same locations. The average humus content is 30%, reaching occasionally 45%. The average lime content (in the form of $CaCO_3$) is 33%, occasionally reaching 40%. The fossil biomass has been proven to contain 64 elements. This means that alginite is especially rich in macro- and microelements, with the most important elements as follows: nitrogen (N): 0.5%, phosphorous (in $P_2O_5$ form): 0.6%, potassium (in $K_2O$ form): 0.9%, magnesium (Mg): 1.0%. The typical mineral components are montmorillonite, illite, dolomite, calcite, aragonite, quartz gypsum, plagioclase, siderite, magnesite, pyrite and orthoclase. In addition to the above the more important microelements are iron (Fe), manganese (Mn), copper (Cu), zinc (Zn), cobalt (Co), nickel (Ni), lithium (Li), titanium (Ti), chromium (Cr) and cadmium (Cd). One of the special characteristics of the humus ingredients is its biochemical plant growth enhancing effect. When alginite is used in agriculture humic acids exert an enzyme-like and also a hormone-like enhancing effect, and—through the regulation of the water-absorbing ability of the roots—also an indirect enhancing effect on plant growth.

Alginite finds widespread use for various purposes. In plant and fruit cultivation alginite can be used for amelioration. Its one-fold use increases the fertility of the soil by 20-30% in the first year. Due to its clay minerals, artificial fertilizers must be used at a higher level, therefore increasing the transfer of phosphorous, nitrogen and potassium from the soil into the ground water, rivers, and lakes. Its effect lasts for 4-6 years. Alginite is a natural material, retains its quality indefinitely, cannot be overused and even higher use levels do not have any adverse effects. Alginite can also be used as garden soil in the form of mixtures. Admixed with other natural materials like zeolite, perlite, peat or basalt, agent-free, highly efficient soil mixtures have been prepared. The use of alginite results in an increase of the quantity and quality of yield in the cultivation of olitories and ornamentals either in the garden or in polytunnels at harvesting. Alginite may also be used as a starter in planting holes of forest tree species. The use of the alginite results in a quantitative increase of 6-13% and 20% quicker growth. Suspension spraying with alginite in the autumn has a plant-protecting effect and helps the hibernation of trees, while the spring spraying provides protection against pests. As a result of alginite spraying, the manganese, iron zinc and copper content of plants increases, while the calcium content in fruits provides more taste and a longer shelf-life. In animal husbandry alginite combined with liquid manure provides a highly effective product for use as complementary treatment of organic fertilizers, or for substitution of the same. Alginite reduces the degradation period of the fertilizer and can be combined with other nutrients. Admixing alginite with litter results in a more substantial fertilizer and enhances the growth of domestic animals and poultry. Alginite also exerts environmental protective effects. Due to its high adsorptive affinity, it effectively binds the odors of animal stalls and reduces the $SO_2$ and $NH_3$ concentration in the air-space (see for example Hungarian Patent No. 189.383: "Process for binding of gases with unpleasant smell produced by dissolving organic materials and for production of organic manure with high efficiency").

Human uses of Alginite include its use as a sludge for joint-, rheumatic and sport problems, and also has the advantage of forming it into an ointment against rheumatism. Alginite us also useful against varicose veins and psoriasis and can also be used for skin regeneration and general enhancement of skin status. Further, alginite can also be used as a base for medical fresheners.

Alginite can be found in Hungary and is commercially available by numerous Hungarian firms, for example from Gérce-Alginit Kft, (Gérce, Hungary)

Surprisingly, alginite has now been found to be effective in a new technical field. Our studies prove that alginite is especially effective when used in cigarette filters alone or in combination with other known components as discussed below. Unexpectedly, it was found that the use of alginite in cigarette filters resulted in significantly less reactive oxygen species (ROS) in saliva, significantly less ROS formation in blood serum, less endothelial damage, less lung epithelium damage, significantly higher glutathione level, less damage in lung tissues and less inflammation in lung tissues, said advantageous properties being disclosed in details below.

The use of alginite causes significantly less reactive oxygen species (ROS) in saliva. Although saliva itself has a certain concentration of free radicals, cigarette smoke causes an increase in the level of free radicals. It is estimated that there are more than $10^{14}$ free radicals per puff of cigarette smoke (Church and Pryor, 1985; Church D F, Pryor W A, "Free-radical chemistry of cigarette smoke and its toxicological implications," Environ Health Perspect, 1985, 64:111-26). Given that free radicals can interact with numerous organic substrates to produce ROS, it is not surprising that cigarette smoke increases the level of ROS in saliva. However, in addition to radicals contained in cigarette smoke, significant radical formation as well as the direct production of ROS can arise from the inflammatory response caused by cigarette smoke, leading to increased levels of neutrophils and macrophages. (Messner and Bernhard, 2014; Messner B, Bernhard D, "Smoking and cardiovascular disease. Mechanisms of endothelial dysfunction and early atherogenesis," Arterioscler Thromb Vasc Biol, 2014, 34:509-15). We measured the antioxidant capacity of the untreated saliva of our volunteers, who then smoked one cigarette, following which their saliva was collected again. We measured the change in the antioxidant capacity level in the saliva using smoke from a control cigarette. We repeated the same exercise with different filters containing both mono alginite only and in four different combinations of alginite with—grape skin and seed (GSS), alginite-special Al oxide, alginite-zeolite alginite-carbon of the same filters in 50-50% mix. All the combination filters with alginite produced significantly less of a decline in antioxidant capacity in the saliva when compared to control filter. Alginite alone produces a significant difference in antioxidant capacity compared to control, but all combination cigarettes fared significantly better than alginite alone, a clear proof that alginite and combination partners act synergistically.

The use of an alginite filter caused significantly less ROS formation in blood serum. The experiment demonstrating this was similar to the saliva experiment, but it was conducted with blood serum. Serum itself has a certain concentration of free radicals. Although serum itself has a certain concentration of free radicals, cigarette smoke causes an increase in the level of free radicals. It is estimated that there are more than $10^{14}$ free radicals per puff of cigarette smoke (Church and Pryor, 1985). Given that free radicals can interact with numerous organic substrates to produce ROS, it is not surprising that cigarette smoke decreases the antioxidant capacity of serum. However, in addition to radicals contained in cigarette smoke, significant radical formation as well as the direct production of ROS can arise from the inflammatory response caused by cigarette smoke leading to increased levels of neutrophils and macrophages. (Messner and Bernhard, 2013). We measured antioxidant capacity of the untreated serum. We then used our smoking machine to channel whole cigarette smoke through a tube of serum. We measured the change in antioxidant capacity in the serum using smoke from a control cigarette. We repeated the same exercise with different filters containing both mono alginite only and a combination of alginite with four different filtering materials, i.e. alginite-grape skin and seed (GSS), alginite-special Al oxide, alginite-zeolite, alginite-carbon of the same filters. All the filters containing alginite produced significantly less of a decline in antioxidant capacity in the serum when compared to control filter.

The use of alginite produced smoke that caused less endothelial damage. The cells that line the inner surface of blood vessels are referred to as endothelial cells. These cells have an important role in protecting these vessels. Once the endothelium is damaged, frequently referred to as endothelial dysfunction, risks for cardiovascular disease increase. Since smoke, when leaving the lung through alveoli, enters the bloodstream, exposure of the endothelium to the smoke occurs and leads initially to endothelial dysfunction, well known to be a crucial first step in the development of smoking-related cardiovascular disease (Ambose and Barua, 2004; Ambrose J A, Barua R S, "The pathophysiology of cigarette and cardiovascular disease. An update," J Am Coll Cardiol, 2004, 43:1731-7; Messner and Bernhard, 2014). We measure endothelial cell damage that occurs when endothelial cells exposed to full smoke are compared to untreated cells. Significantly less cell damage occurs when the same cell line is exposed to alginite filtered smoke or a smoke filtered with a combination containing alginite.

The use of alginite also resulted in smoke that caused less lung epithelium damage. The lung epithelium is the first line of defense with respect to inhaled toxicants. Alveolar epithelial cells in the lung are known to be damaged by smoke exposure up to and including cell death (Kosmider et al., 2011; Kosmider B, Messier E M, Chu H W, Mason R J, "Human alveolar epithelial cell injury induced by cigarette smoke," PLoS One, 2011, 6:e26059), which is evidenced by a decline of healthy cell number compared to untreated cells. Alginite containing filtered smoke caused a significantly lower decrease in healthy cell number count as compared to a control cigarette. Since necrotic epithelial cells secrete proteins into the lung that trigger inflammation, which eventually may lead to lung cancer or COPD, protecting the epithelium by the filters containing alginite and combination of four different filtering materials paired with i.e. alginite with—grape skin and seed (GSS), alginite-special Al oxide, alginite-carbon of the same filters is clearly a health benefit for smokers.

Glutathione levels were also significantly higher with alginite filtered cigarette smoke compared to control cigarette. Both epithelial and endothelial cell lines were exposed to control cigarette and alginite and and a combination of alginite with—grape skin and seed (GSS), alginite-special Al oxide, alginite-carbon of the same filters, such alginite containing filtered cigarette whole smoke. Determination of glutathione levels indicated significantly greater levels of glutathione in cells exposed to smoke from the alginite filtered cigarettes compared to the control cigarette. Given that it is well known that glutathione protects against oxidative stress (Rahman and MacNee, 2000; Rahman I, MacNee W, "Oxidative stress and regulation of glutathione in lung inflammation," Eur Respir J, 2000, 16:534-54), this means that alginite containing filters better protect the indigenous defense mechanism of the lung against oxidative stress-induced tissue damage of the lung than does the control cigarette.

Alginite filtered smoke caused less damage in lung tissues and caused less inflammation compared to control cigarette smoke. A three-dimensional lung tissue—designated as spheroids—has been constructed from human cells with a known profile, namely lung epithelial cells, fibroblasts, endothelial cells and macrophages. The three dimensional construction allows the cells to develop a functional organization, similar to that found in their in vivo counterparts. The 3D models offer a much better experimental model to simulate the in vivo environment than conventional monoculture-monolayer (2D) systems. The biochemical profile of a 3D tissue culture is strikingly similar to that of the living organism. 3D spheroids react to external stimuli similarly to living peripheral lung tissue. Their inflammatory response is almost identical, and they produce surfactant as well. When these 3D spheroids were exposed to cigarette smoke filtered through novel alginite cigarette filters, the level of the cytokines IL-8 and IL-6, known inflammatory mediators, were expressed to a significantly lesser degree compared to control cigarettes.

As mentioned above, alginite can be used in the filters of the invention alone or in combination with other substances used in cigarette filters before the filing date of the present invention. Such materials as well as their preparation and use are known for persons skilled in the art.

For example, when in respect of the cigarette filters "carbon" or "grape" or "grape components" are mentioned they mean activated carbon and grape pip and skin grist, although, from the prior art it is apparent for a person skilled in the art that grape components may be present in other forms as well. These components, as well as their availability are also well known for persons skilled in the art.

The present invention is hereby disclosed in more detail through the following examples. The Examples are for illustrative purposes only. From the Examples a person skilled in the art will readily understand that alginite even alone has significantly improved filtering characteristics over the known filtering materials. Moreover, the Examples containing data regarding to combinations containing alginite and certain filtering materials belonging to the prior art will make it clear to a person skilled in the art, that alginite acts synergistically with other filtering materials. With regard to said materials we refer for example also to the free radical scavengers disclosed in WO 2010/125412 mentioned above and incorporated herein by reference. Therefore, although not all combinations containing alginite are listed in the examples, a person skilled in the art understands that the combination partners of alginite may be counterchanged arbitrarily with other suitable filtering materials and that all such combinations are encompassed by the present invention.

Example 1: The Use of Alginite Causes a Significantly Lesser Increase in Antioxidant Status in Saliva and Serum—Budapest University of Technology (BUT) Experiments The goal of this study was to investigate the effects of different filters on cigarette smoke's ability to alter the antioxidant state of the samples (serum and saliva). Measurements of serum samples were carried out with RANDOX® TAS assay. Serum samples were prepared by reconstituting lyophilized serum, which were measured either after reconstitution (blank) or after filtered cigarette smoke was bubbled through it. The total antioxidant status of saliva was measured before and after smoking a conventional or experimental cigarettes equipped with filters according to the invention. The data acquired by our measurements could reflect the free radical and ROS binding capacity of the filters.

Materials and Methods

Measurements for Antioxidant Status with Benzidine Assay and Randox® Total Antioxidant Status (TAS) Kit Measurements for antioxidant status were carried out by the widely accepted benzidine assay and the commercially available Randox® Total Antioxidant Status (TAS) kit. The benzidine assay utilizes a peroxide generating system (hydrogen peroxide and peroxidase) and a peroxide sensitive chromogen (benzidine). The in situ generated peroxides react with the chromogen to give an intermediary compound with peak absorbance at 620 nm detectable with a spectrophotometer. Antioxidants present in the sample compete with the chromogen in its reactions with the peroxides and hinder the generation of the detectable signal. By comparing the samples' detectable chromogen formation to a negative control with no antioxidants present and to a positive control with a known antioxidant concentration, the samples' antioxidant status can be estimated.

Reagents and Instruments Used

Reagent A (dissolved in Type II purified water)

155 mM sodium chloride (Reanal, cat. no. 24640-1-08-38)

25 mU/ml horseradish peroxidase (Sigma®, cat. no. 77332)

233 μM benzidine dihydrochloride (Sigma®, cat. no. B3383)

Reagent B (dissolved in Type II purified water)

250 μM urea-hydrogen peroxide (Sigma®, cat. no. 289132)

Samples

Saliva samples were taken from 17 subjects before and after cigarette smoking. Volunteers were recruited by OF Laboratories at Budapest University of Technology and Economics. Each volunteer reported between 8-9 am for saliva harvesting, cigarette smoking and saliva harvesting again. Each morning one trial cigarette was smoked and saliva was collected. Each volunteer smoked 4 different cigarettes (distinguished by the filter); two between Dec. 4-7, 2015 and two between Jan. 5-8, 2016. Smokers were requested to report for smoking not having taken any food or liquid that morning and not having brushed their teeth. Saliva was iced and carried for evaluation within the premises to BUT laboratories.

| Male | | Female | |
|---|---|---|---|
| 14 people | | 3 people | |
| Smoker | Non-smoker | Smoker | Non-smoker |
| 12 | 2 | 2 | 1 |
| Age | | Age | |
| 18-24 years | 6 people | 18-24 years | 2 people |
| 25-40 years | 4 people | 25-40 years | 0 person |
| 41-59 years | 3 people | 41-59 years | 1 person |
| 60+ years | 1 person | 60+ years | 0 person |

Serum samples were reconstituted from lyophilized serum (Analyticon Contronorm® PLUS), according to the manufacturers' instructions, in Type II purified water. Serum samples were either measured directly (blank) or after filtered cigarette smoke was bubbled through the serum by OptiFilter. Cigarettes were smoked using the Filtrona SM302 8-port, linear smoking machine. Cigarettes were smoked according to ISO 3308 with 100% of the filter ventilation holes blocked. The smoke was passed through a Cambridge Filter (Glass fiber filter 44 mm, art. no: 80202851, Borgwaldt KC), and the resulting gas phase was channeled through a silicone tube and bubbled into a glad container (impinger) containing 1.5 ml serum solution. After each cigarette, the Cambridge Filter pad was replaced with a new one, after each cigarette the silicone tube was replaced by a new one. Filters were labeled 1-3.

Controls and Measuring Tools negative control (Type II purified water)

positive control (Calibrator standard from Randox® Total Antioxidant Status kit cat. no. NX 2332)

Randox® Total Antioxidant Status kit

Spectrophotometer (Thermo Scientific™ Multiskan™ GO Microplate Spectrophotometer)

Benzidine Assay Method

Measurements were carried out with the microplate spectrophotometer described above, cells were incubated at 37° C. on a 96-well plate. The reaction mixture on the microplate was prepared as follows: 5 μl of sample or control and 250 μl Reagent A were pipetted into the wells. The mixture was then homogenized and then read by the microplatereader. An initial absorbance reading at λ=620 nm was determined prior to the addition of 50 μl of Reagent B in order to initiate peroxide generation, following which absorbance readings were determined at λ=620 nm from 0 to 3 minutes. Absorbance results were considered as the measured absorbance values at 2.5 minutes. All samples and controls were stored on ice, and each sample was measured in 3 parallel wells for statistical analysis.

Randox® Total Antioxidant Status (TAS) Kit Method

Measurements were carried out according to the supplied manual using a microplate spectrophotometer described above. By using a microplate instead of a cuvette all the required reagent volumes were reduced by a factor of 4. This resulted in a final reaction volume of 305 μl which resulted from the addition of 5 μl of sample or control, 250 μl of Reagent A and 50 ill of Reagent B as described in the manual.

Cigarette Material

Cigarettes used in the experiment were provided by OptiFilter Zrt. The specifications and the fabrication of the cigarettes were as follows. Kentucky Reference Cigarettes 3R4F were manufactured and assembled by the University of Kentucky, KY US. The reference cigarettes were provided to OptiFilter Zrt of Hungary by Celanese Corporation, Narrows, Va., US. Cigarette filters were assembled, and trial cigarettes were produced bY0iitiFilter Zrt. CellFx filter rods were prepared and provided by Celanese Corporation. These contained different filtering materials, sometimes mixed. Additional acetate filter materials with different weave characteristics, thereby producing different pressure drop values, were manufactured and provided by Celanese Corporation. Kentucky Reference Cigarette (KRC) 3R4F filter's 27 mm acetate parts (2.9/41,000) were removed and discarded. Filter rods, manufactured by Celanese's CellFx technology, contained different filling materials. One selected filter rod was introduced facing the burning surface of the cigarette, and an additional acetate part was selected and introduced to the filter, ensuring that the pressure drop (total resistance to draw) value of the cigarette (filter ventilation closed) was the same as the KRC's pressure drop value (resistance to draw 170 mm $H_2O$+/−2%). Celanese rods were 12 mm long. The acetate parts were 15 mm long. The total filter length was 27 mm.

Summary of the Filters Used in the Experiment

| Saliva | Filter Description | Abbreviation |
|---|---|---|
| Filter 1 | Kentucky Control Reference Cigarette | Kent. Ref. |
| Filter 2 | Celanese Rod 12 mm: Carbon | CelRod-12-C |
| Filter 3 | Celanese Rod 12 mm: 50% Alginite & 50% Grape | CelRod-12-AG |

| Serum | Filter Description | Abbreviation |
|---|---|---|
| Filter 1 | Kentucky Control Reference Cigarette | Kent. Ref |
| Filter 2 | Celanese Rod 12 mm: Carbon | CelRod-12-C |
| Filter 3 | Celanese Rod 12 mm: 50% Alginite & 50% Grape | CelRod-12-AG |

Results

During the test carried out on saliva and serum the following test results were obtained.

Serum Experiment

| Sample | | ROS status | Antioxidant capacity | Alteration in anti-oxidant state |
|---|---|---|---|---|
| Serum 1 | Blank | 33% | 67% | |
| | Filter 1 | 44% | 56% | −16% |
| | Filter 2 | 47% | 53% | −21% |
| Serum 2 | Blank | 21% | 79% | |
| | Filter 3 | 30% | 70% | −11% |

The alteration in the antioxidant state is shown in FIG. 1.

The measurements were carried out in five replicates. The results indicate that filter 3 is superior to the control cigarette (filter 1).

Results of Saliva Sample Measurements with Benzidine Assay

The measurement was carried out with 17 subjects. Each sample collected from the subjects was measured 3 times.

| | | Average decrease in antioxidant state |
|---|---|---|
| Filter 1 | Decrease in antioxidant state | 29% |
| Filter 2 | Decrease in antioxidant state | 33% |
| Filter 3 | Decrease in antioxidant state | 12% |

Statistical Analysis of the Saliva Experiment

Assessment of the statistical significance of changes in antioxidant state before and after cigarette smoking was conducted using Wilcoxon Matched pair Test (StatSoft-STATISTICA10). Results were considered significant at $p<0.05$.

| | Wilcoxon Matched Pairs Test Marked tests are significant at p < .05000 | | | |
|---|---|---|---|---|
| Pair of Variables | Valid N | T | Z | p-value |
| Before Filter 1 & After Filter 1 | 17 | 15.5000 | 2.8876 | 0.0038 |

The change in antioxidant state before and after smoking of Filter 1 is significant. The results obtained from the test indicate a strong statistical difference.

| | Wilcoxon Matched Pairs Test Marked tests are significant at p < .05000 | | | |
|---|---|---|---|---|
| Pair of Variables | Valid N | T | Z | p-value |
| Before Filter 2 & After Filter 2 | 17 | 8.0000 | 3.2426 | 0.0011 |

The change in antioxidant state before and after smoking of Filter 2 is significant. The results obtained from the test indicate a strong statistical difference.

| | Wilcoxon Matched Pairs Test Marked tests are significant at p < .05000 | | | |
|---|---|---|---|---|
| Pair of Variables | Valid N | T | Z | p-value |
| Before Filter 3 & After Filter 3 | 17 | 37.5000 | 1.8461 | 0.0648 |

There is no statistically significant change in the antioxidant state before and after smoking Filter 3; although there is an observable difference (p=0.065) it does not reach the threshold for statistical significance.

Assessment of the statistical significance of changes in antioxidant state caused by smoking different cigarettes was conducted using Wilcoxon Matched pair Test (StatSoft-STATISTICA10). Results were considered significant at p<0.05.

| | Wilcoxon Matched Pairs Test Marked tests are significant at p < .05000 | | | |
|---|---|---|---|---|
| Pair of Variables | Valid N | T | Z | p-value |
| Filter 1 & Filter 2 | 17 | 66.0000 | 0.4970 | 0.6191 |

The change in antioxidant state between filter 1 and 2 is not significant.

| | Wilcoxon Matched Pairs Test Marked tests are significant at p < .05000 | | | |
|---|---|---|---|---|
| Pair of Variables | Valid N | T | Z | p-value |
| Filter 1 & Filter 3 | 17 | 29.0000 | 2.2485 | 0.0256 |

The change in antioxidant state between filter 1 and 3 is significant.

Figure 2:
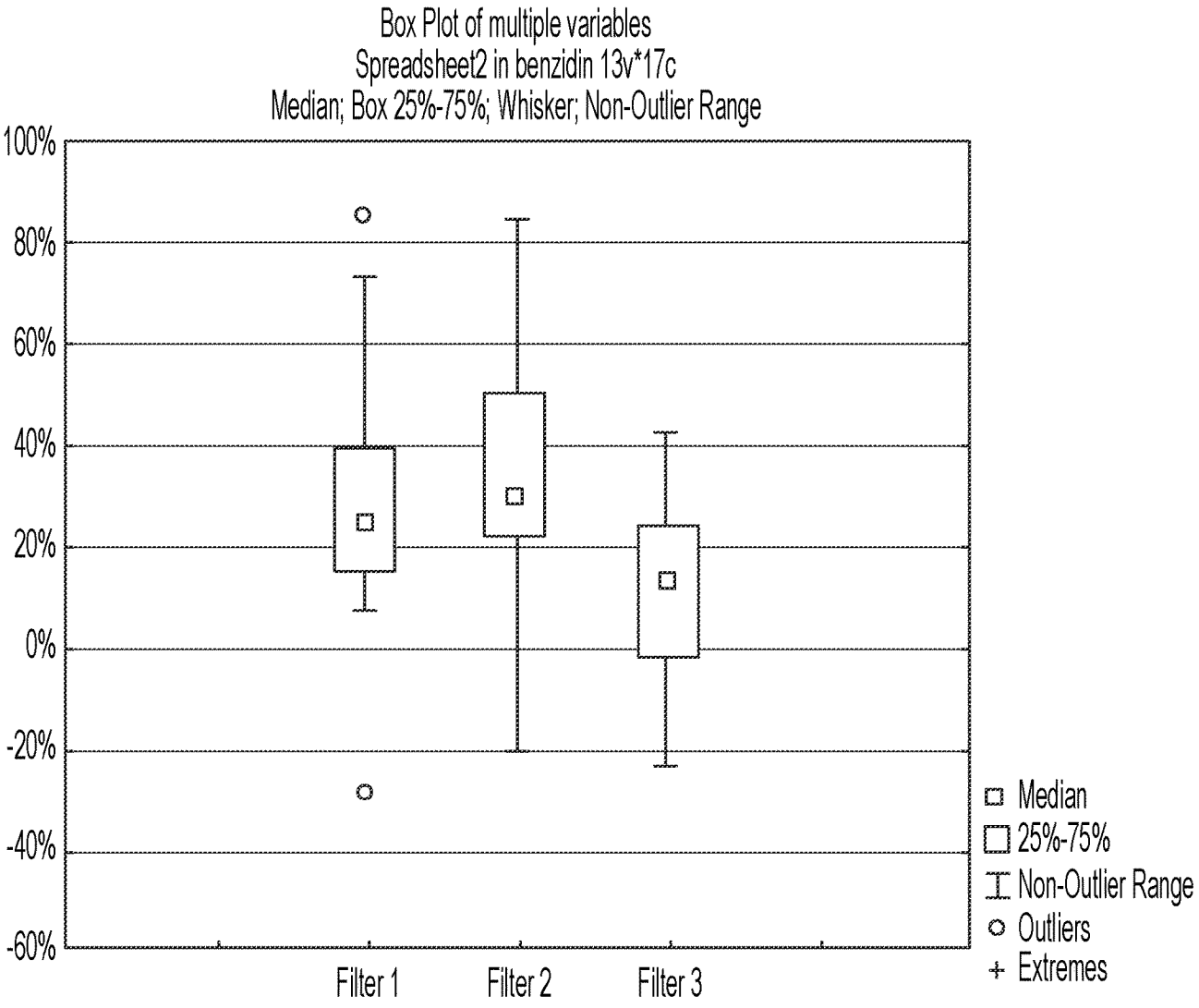
FIG. 2 is a diagram representing comparative results of different filter compositions relating to a decrease in antioxidant status before and after cigarette smoking.

Representation of the Results of the Decrease in Antioxidant Status Using a Box Plot Diagram The relating Box Plot diagram of multiple variables is shown in FIG. 2. Outlying data points are shown separately (StatSoft-STATISTICA10).

Conclusions

Our results show that the cigarette smoke which was passed through either Filter 1 or 2 reduced the serum antioxidant status by 15-20%. Filter 3 resulted in significantly less antioxidant capacity decrease, compared to control.

The absorbance readings of the saliva samples were compared to positive and negative controls to assess antioxidant status. Our results indicate that cigarette smoke which passed through Filter 1 and 2 lowered the saliva antioxidant state by about 30%, which was found to be statistically significant, while Filter 3 showed a decrease of 12%, statistically significant compared to control cigarette. These results are consistent with those on serum measurements. Our results show that components of the filters of the invention have a significant effect on the cigarette smoke's ability to change the antioxidant state of the samples under the assay conditions described.

Example 2: The Use of Alginite Causes a Significantly Lesser Increase in Antioxidant Status in Saliva and Serum—Experiments by Prof. Tibor Szarvas The effect on saliva and serum of the cigarette smoke filtered by the filters of the invention was also tested in an additional experiment as follows.

Materials and Methods

Cigarettes used in the experiment were Kentucky Reference Cigarettes 3R4F, manufactured and assembled by the University of Kentucky, KY, US. The test cigarettes were provided to OptiFilter Zrt of Hungary by Celanese Corporation, Narrows, Va., US. Cigarette filters were assembled, and trial cigarettes were produced by OptiFilter Zrt. CellFx filter rods were prepared and provided by Celanese Corporation. These contained different filtering materials, sometimes mixed. Additional acetate filter materials with different weave characteristics, thereby producing different pressure drop values, were manufactured and provided by Celanese Corporation. Kentucky Reference Cigarette 3R4F filter's 27 mm acetate parts (2.9/41,000) were removed and discarded. Filter rods, manufactured by Celanese's CellFx technology, contained different filling materials. One, selected filter rod was introduced facing the burning surface of the cigarette, an additional acetate part was selected and introduced into the filter, ensuring that the pressure drop (total 'resistance to draw) value of the cigarette (filter ventilation closed) was the same as the KRC's pressure drop value (resistance to draw 170 mmH2O+/−2%). Celanese rods were either 10 mm or 12 mm or 15 mm long. The acetate parts were by either 17 mm or 15 mm or 12 mm long.

The total filter length was 27 mm. Cigarettes equipped with CellFx filter rods containing different filling materials were measured and compared to control in this biological evaluation.

The following filters were used in the experiments:

| Filter Description | Abbreviation |
|---|---|
| Cavity: 100 mg, (33-67) Al-O-Grape | Cav-100-AlOG |
| Cavity: 150 mg, 50-50%, Alginite & Grape | Cav-150-AG |
| Cavity: 150 mg, 50-50%, Zeolite & Grape | Cav-150-ZG |
| Cavity: 160 mg, 50-50%, Al-O & Grape | Cav-160-AlOG |
| Cavity: 160 mg, (20% each), Al-O + Grap + Alg + Zeol + Carb | Cav-160-AOGAZC |
| Cavity: 200 mg: (120-80 mg), Alginite-Grape | Cav-200-AG |
| Celanese Rod 10 mm, 50-50%, Alginite-Carbon Rod | CelRod-10-AC |
| Celanese Rod 10 mm: Carbon Mono Rod | CelRod-10-C |
| Celanese Rod 12 mm: 50-50%, Alginite & Grape | CelRod-12-AG |
| Celanese Rod 12 mm: Carbon | CelRod-12-C |
| Celanese Rod 15 mm: 50-50%, Alginite & Carbon | CelRod-15-AC |
| Celanese Rod 15 mm: 50-50%, Alginite & Grape | CelRod-15-AG |
| Kentucky Control Reference Cigarette | KRC. |

Experimental Setup

Cigarettes were smoked in OF laboratory at University of Technology and Economics, Budapest, in a Filtrona SM302 8-port, linear smoking machine according to ISO 3308 protocol. Cigarettes were smoked with filter ventilation holes blocked. The cigarette smoke was passed through a Cambridge Filter (Glass fiber filter 44 mm, art. no: 80202851, Borgwaldt KC), and the resulting gas phase was channeled through a silicone tube and bubbled into a glass container (impinger) containing 1.5 ml serum solution. After each cigarette, the Cambridge Filter pad was replaced with a new one, and after each cigarette the silicone tube was replaced by a new one.

Measuring Serum Antioxidant Capacity

For the evaluation of the free radical binding capacity of the new experimental cigarette filters two methods were employed:

1.) Randox—total antioxidant kit (purchased from Randox Lab. Ltd., Crumlin, UK)

2.) HRP—peroxide-benzidine assay

Contronorm Plus control serum was supplied by Analyticon Biotechnologies AG, Germany. Cigarette smoking and treating the serum with smoke was performed at OF laboratories at University of technology and Economics, Budapest, and readout assays were performed by Dr. Szarvas at Central Research Institute for Physics Campus, at the Energy Center of the Hungarian Academy of Sciences, Budapest. Freshly prepared reagents were used. Control serum was dissolved in 5 ml of double-distilled water. After the cigarette smoke (1 cigarette) was passed through a Cambridge filter, the resulting gas phase was bubbled into 1.5 ml of dissolved serum according to ISO 3308 protocol with filter ventilation holes blocked. Thereafter, 20 μl of treated serum was mixed with 1 ml of Reagent 1 (composition provided below), homogenized and the reaction started with 200 μl of Reagent 2 (composition provided below). The change of absorbance was measured after 3 minutes. The absorbance of the bubbled serum was compared with the absorbance of the non-reacted control serum. A blank value was determined without control serum using 20 μl of double-distilled water. Measurements were also carried out on plate reader (parameters: 5 μl of serum, 250 μl of R1, 50 μl of R2 reagents).

Randox Assay to Determine the Total Antioxidant Status in Serum

Assay principle: ABTS (2,2,'-Azino-bis(3-ethylbenzthiazoline-6-sulphonate) is incubated with a peroxidase (metmyoglobin) and $H_2O_2$ to produce the radical cation ABTS+. This has a relatively stable blue-green color, which is measured at 600 nm. Antioxidants in the added sample cause suppression of this color, to a degree proportional to their concentration.

Sample: Contronorm control serum.

| Reagent | Composition | Conc. in the test |
|---|---|---|
| R1 | Buffer<br>Phosphate Buffered Saline | 80 mmol/L,<br>pH 7.4 |
| R2 | Chromogen<br>Metmyoglobin | 6.1 μmol/L |
| R3 | Substrate<br>Hydrogen peroxide (in stabilized form) | 250 μmol/L |
| CAL | Standard<br>6-hydroxy-2,5,7,8-tetramethyl-chroman-2-carboxylic acid | lot specific |

Procedure

Wavelength: 600 nm

Cuvette: 1 cm light path

Temperature: +37° C.

Measurement: against air

Double-distilled water is mixed with 1 mL R2 reagent. The standard is mixed with 1 mL R2 reagent. The sample is mixed with 1 mL R2 reagent. Each solution is mixed well, incubated to achieve the necessary temperature, and the initial absorbance (A1) is read. To each solution 200 μl of R3 is added. Mix and timer are started simultaneously. Absorbance is read after exactly 3 minutes (A2). Total antioxidant status expressed in % is established comparing reagent serum value.

HRP Peroxide-Benzidine Assay

Reagent 1 HRP (horse radish peroxidase) 9000 U/L, benzidine hydrochloride 233 μmol/L, sodium chloride 155 mmol/L, Reagent 2: Carbamide peroxide 0.36 mmol/L Solvent: Double-distilled water Instrument: UV-VIS spectrophotometer, temperature 25° C.

Freshly prepared reagents were used. Control serum was dissolved in 5 ml of double-distilled water. After the cigarette smoke was filtered using a Cambridge filter (1 cigarette), the resulting gas phase was bubbled into 1.5 ml amount of serum solution according to ISO 3308 protocol. Filter ventilation holes were blocked. Thereafter 20 μl of treated serum solution was mixed with 1 ml of Reagent 1 and homogenized, and the reaction was started with 200 μl of Reagent 2. The change of absorbance at 620 nm was measured immediately after 3 minutes. The absorbance of the bubbled serum was compared with the absorbance of the non-reacted control serum. The blank result was obtained without control serum using 20 µl of double-distilled water. The results of the experiments are summarized in the Tables. Measurements were also carried out on a plate reader (parameters: 5 µl of serum, 250 µl of R1, 50 µl of R2 reagents.

Results

1. HRP Peroxide-Benzidine Assay

| TYPE | ABBREVIATION | Reactive O Radical production (%) | Antioxidant capacity to reagent (%) | Improvement compared to control (%) |
|---|---|---|---|---|
| Kentucky Control Reference Cigarette | KRC | 64.7 | 35.3 | |
| Celanese Carbon Mono Rod (length 10 mm) | CelRod-10-C | 56 | 44 | 25 |
| Celanese: Alginite-Carbon Rod (length 10 mm) | CelRod-10-AC | 37.3 | 62.7 | 78 |
| Cavity: 200 mg Alginite-Grape (120-80 mg) | Cav-200-AG | 38.2 | 61.8 | 75 |
| Cavity: Al-O-Grape (33-66-mg) | Cav-100-AIOG | 59.1 | 40.9 | 16 |
| Celanese: Rod Alginite-Grape (length 15 mm) | CelRod-15-AG | 35.2 | 64.8 | 84 |
| Cavity: Alginite-Grape (75-75 mg) | Cav-150-AG | 44.7 | 55.3 | 57 |

Figure 3:
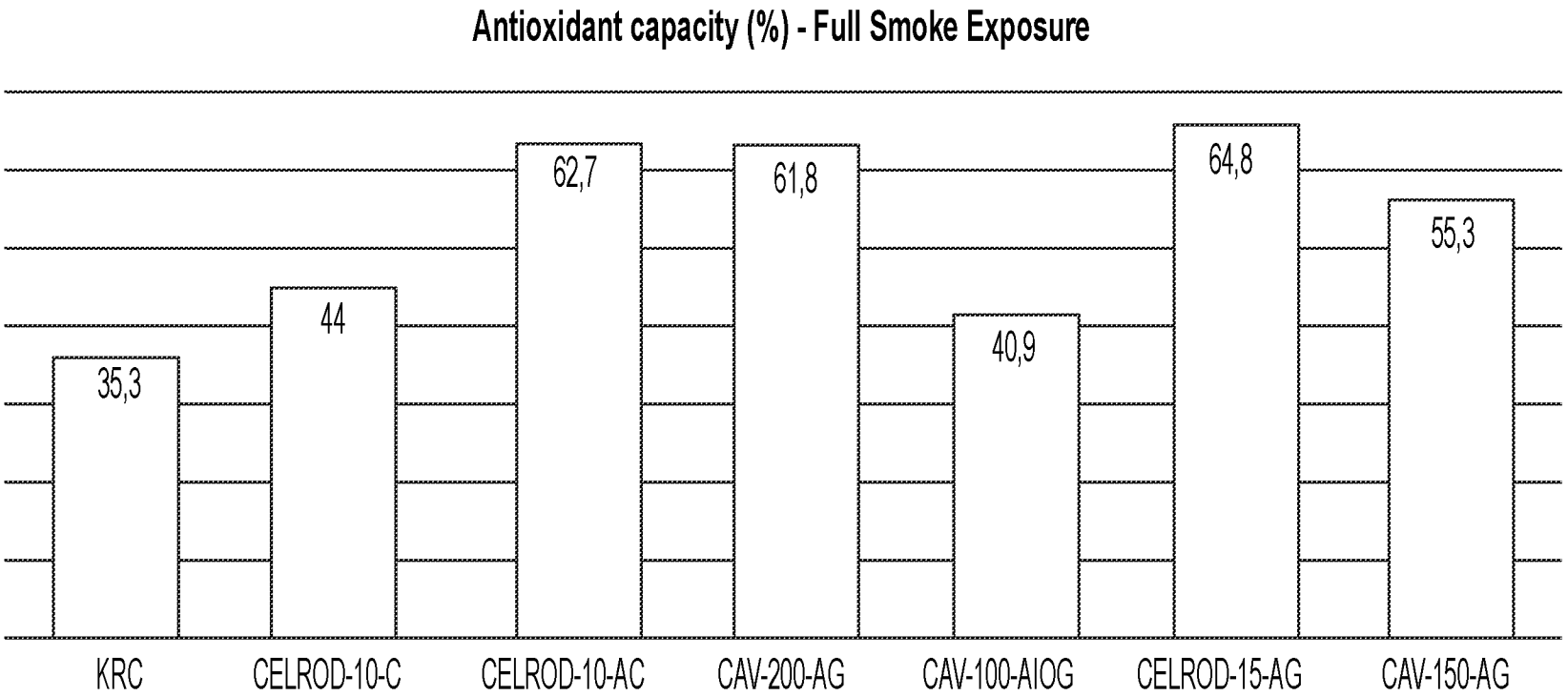
FIG. 3 is a diagram illustrating an antioxidant capacity of different filter compositions, including a control filter composition, with full smoke exposure according to an HRP peroxide-benzidine assay.
Figure 4:
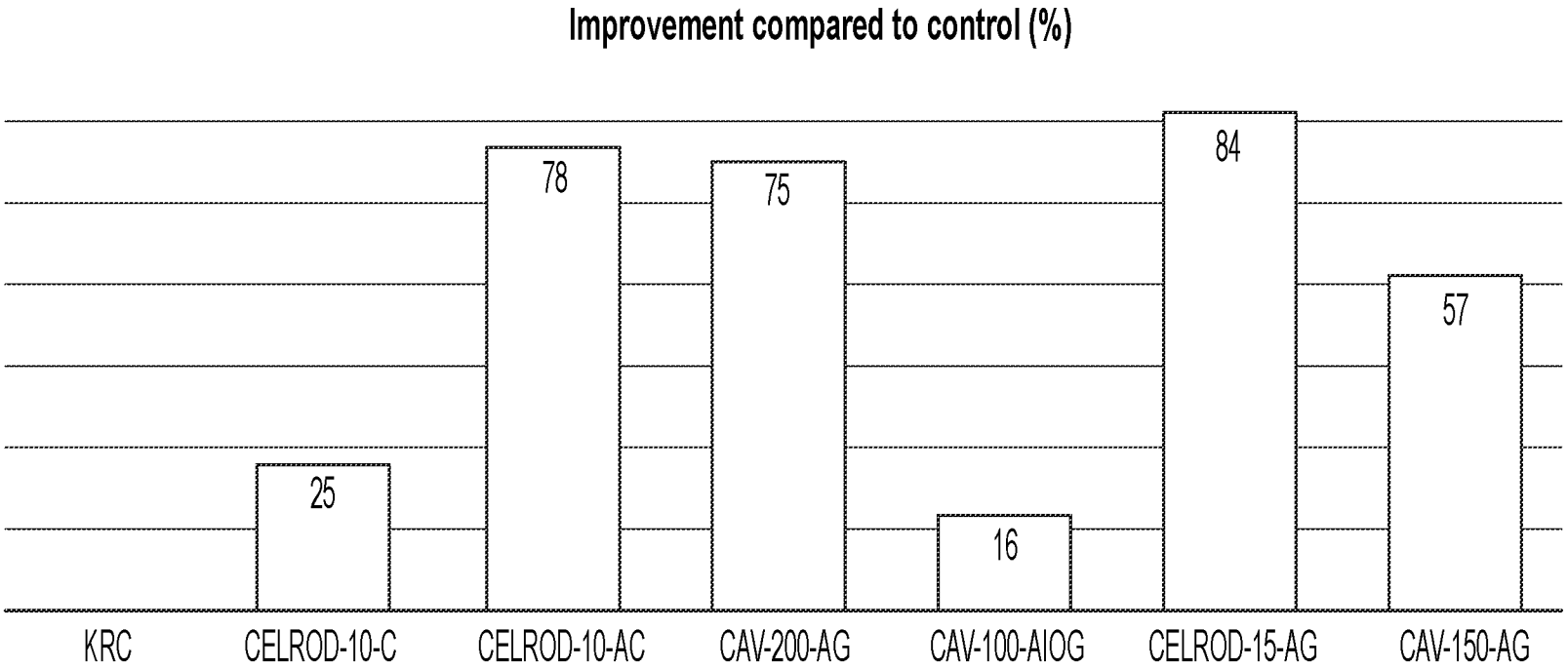
FIG. 4 is a diagram illustrating an improvement of antioxidant status of a portion of the different filter compositions compared to the control filter composition of FIG. 3.

The antioxidant capacity and the improvement compared to the control are shown in FIG. 3 and FIG. 4. respectively.

2, Comparing Cavity and CelFx Filters of the Invention in Serum

HRP Peroxide-Benzidine Assay

| TYPE | ABBREVIATION | Reactive O Radical production (%) | Antioxidant capacity to reagent (%) | Improvement compared to control (%) |
|---|---|---|---|---|
| Kentucky Control Reference Cigarette | KRC | 76 | 24 | |
| Cavity 160 mg, AL-O + GRAPE + ALGINITE + ZEOLITE + CARBON | Cav-160-AIOGAZC | 60 | 40 | 64 |
| Cavity: 160 mg. 50% Al-O & 50% + Grape | Cav-160-AIOG | 65 | 36 | 47 |
| Cavity 150 mg. 50% Zeolite & 50% Grape | Cav-150-ZG | 74 | 26 | 7 |
| Cavity: 150 mg. 50% alginite & 50% Grape | Cav-150-AG | 45 | 55 | 129 |
| Celanese Rod 15 mm: 50% Alginite & 50% Grape | CelRod-15-AG | 69 | 31 | 27 |
| Celanese Rod 15 mm: 50% Alginite & 50% Carbon | CelRod-15-AC | 45 | 55 | 126 |

Figure 5:
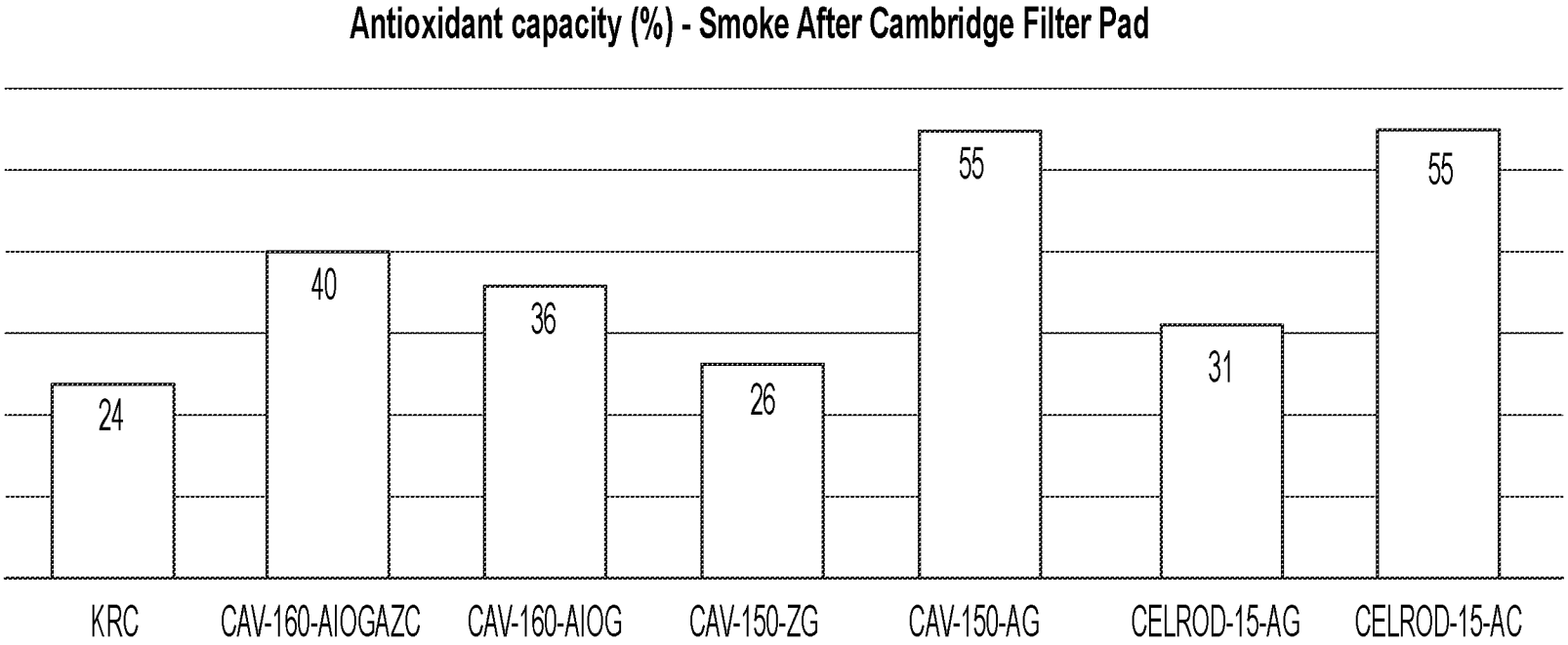
FIG. 5 is a diagram illustrating an antioxidant capacity of different filter compositions, including a control filter composition, with smoke exposure following a Cambridge filter pad according to an HRP peroxide-benzidine assay.
Figure 6:
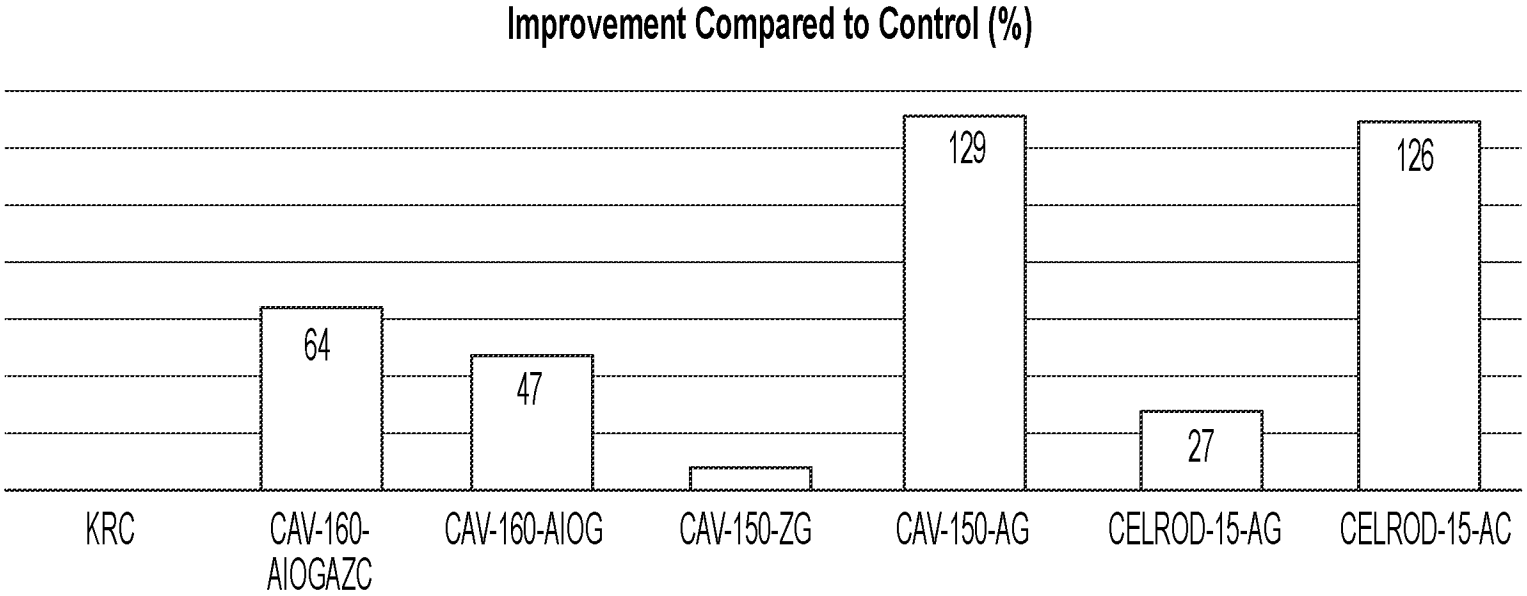
FIG. 6 is a diagram illustrating an improvement of antioxidant status of a portion of the different filter compositions compared to the control filter composition of FIG. 5.

The antioxidant capacity and the improvement compared to the control are shown in FIG. 5 and FIG. 6. respectively.

3, Randox Assay

The serum experiment was repeated with the Randox Antioxidant Kit methodology. The results are shown below.

| Samples | Abbreviation | Absorbance | Reactive O Radical production | Antioxidant capacity | Decrease of antioxidant capacity to serum (%) | Improvement compared to control (%) |
|---|---|---|---|---|---|---|
| Reagent (Randox) | | 0.256 | 100 | | | |
| Calibration Standard | | 0.005 | 1.9 | 98.1 | | |
| Serum | Serum | 0.136 | 53.1 | 46.9 | | |
| Kentucky Control Reference Cigarette | KRC | 0.151 | 58.9 | 41.1 | 12 | |
| Celanese Rod 12 mm: 50% Alginite & 50% Grape | CelRod-12-AG | 0.123 | 48.04 | 51.96 | −11 | 187 |
| Celanese Rod 12 mm: Carbon | Cel Rod-12-C | 0.154 | 60.1 | 39.9 | 15 | −21 |
| Cavity 200 mg: Alginite-Grape (120-80 mg) | Cav-200-AG | 0.145 | 53.9 | 46.1 | 2 | 86 |

Figure 7:
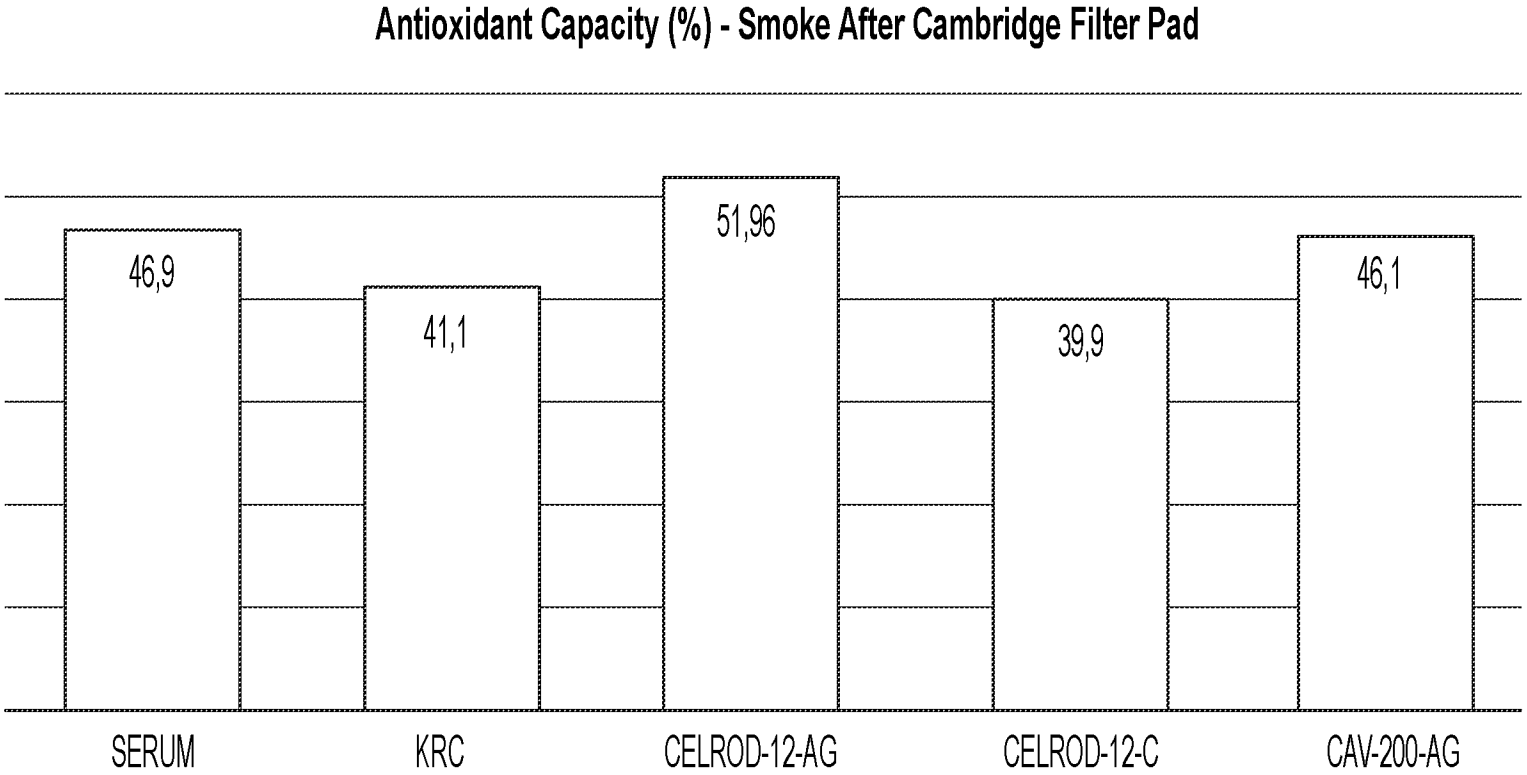
FIG. 7 is a diagram illustrating an antioxidant capacity of different filter compositions, including a Kentucky cigarette and a control serum, with smoke exposure following a Cambridge filter pad according to a Randox assay.
Figure 8:
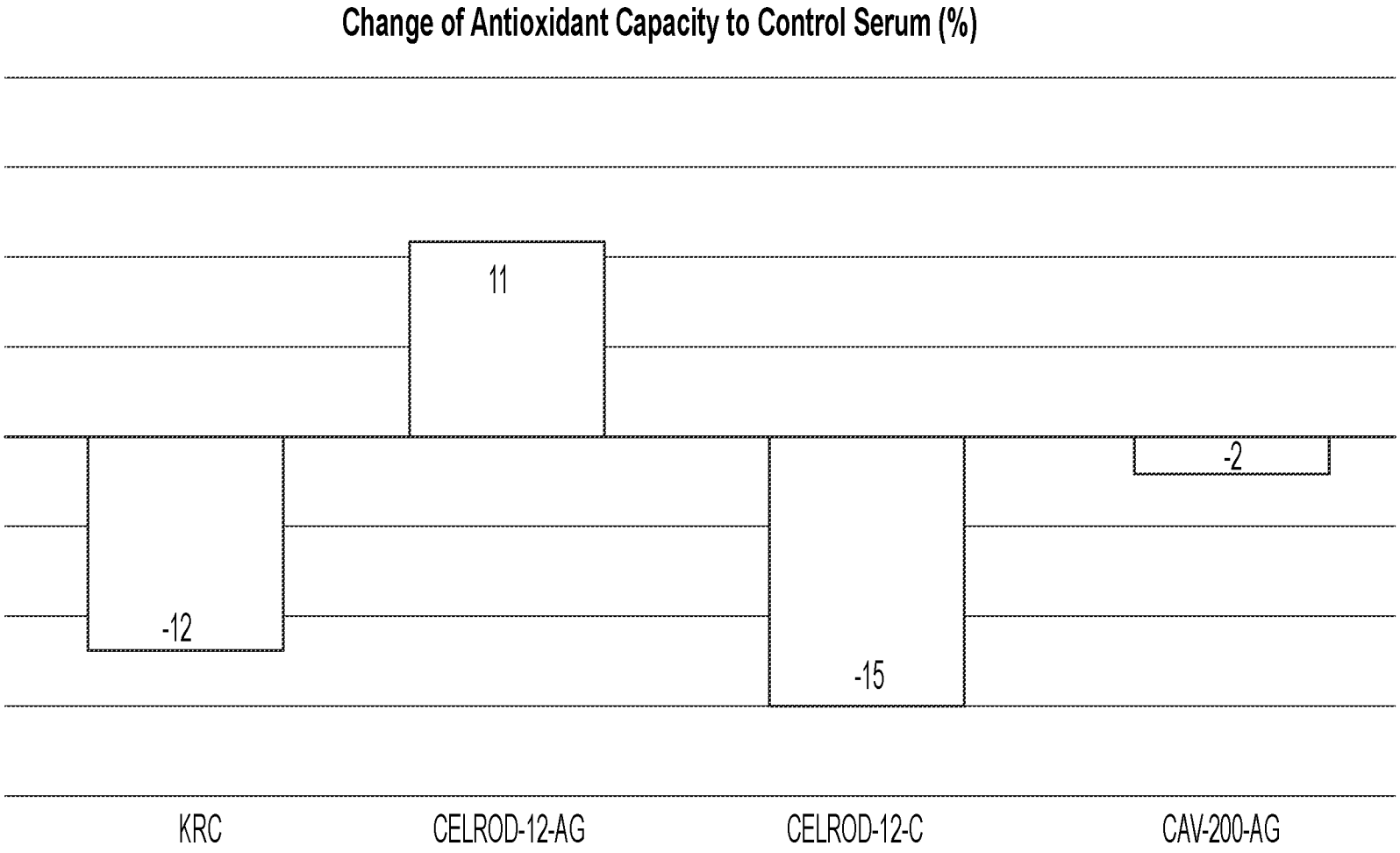
FIG. 8 is a diagram illustrating a change of antioxidant capacity of a portion of the different filter compositions compared to the control serum of FIG. 7.
Figure 9:
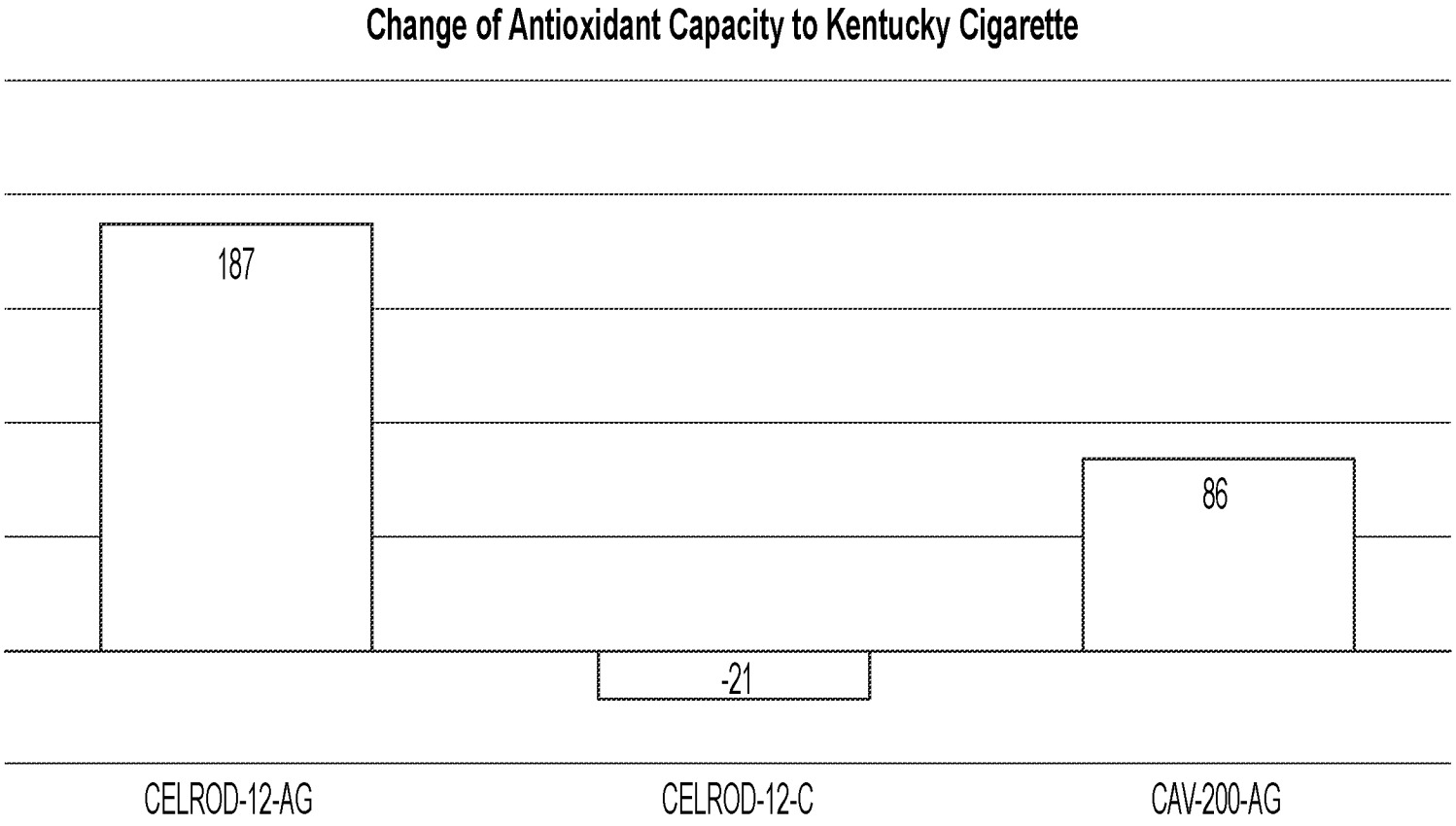
FIG. 9 is a diagram illustrating a change of antioxidant capacity of the portion of the different filter compositions of FIG. 8 compared to the Kentucky Cigarette of FIG. 7.

The antioxidant capacity, the change of antioxidant capacity to control serum and the change of antioxidant capacity to Kentucky Cigarette shown in FIG. 7, FIG. 8. and FIG. 9. respectively.

The serum results with the Randox methodology confirmed that the filters of the invention, both in CellFx structures and in cavity, significantly improve the antioxidant status triggered by gas phase cigarette smoke. Considering that cigarette smoke enters the bloodstream seconds after inhaled, the use of the filter of the invention may result in healthier endothelium status in smokers.

Measuring Saliva Antioxidant Capacity

To evaluate the free radical status change of the saliva after smoking and compare different filtered cigarettes triggered changes in the saliva of the smoker was measured and compared.

Materials and Methods

Cigarettes used in the experiment were Kentucky Reference Cigarettes 3R4F, manufactured and assembled by the University of Kentucky, KY, US. The test cigarettes were provided to OptiFilter Zrt of Hungary by Celanese Corporation, Narrows, Va., US. Cigarette filters were assembled, and trial cigarettes were produced by OptiFilter Zrt. CellFx filter rods were prepared and provided by Celanese Corporation. These contained different filtering materials, sometimes mixed. Additional acetate filter materials with different weave characteristics, thereby producing different pressure drop values, were manufactured and provided by Celanese Corporation. Kentucky Reference Cigarette 3R4F filter's 27 mm acetate parts (2.9/41,000) were removed and discarded. Filter rods, manufactured by Celanese's CellFx technology, contained different filling materials. One, selected filter rod was introduced facing the burning surface of the cigarette, an additional acetate part was selected and introduced into the filter, ensuring that the pressure drop (total resistance to draw) value of the cigarette (filter ventilation closed) was the same as the KRC's pressure drop value (resistance to draw 170 mmH2O+/−2%). Celanese rods were either 10 mm or 12 mm or 15 mm long. The acetate parts were by either 17 mm or 15 mm or 12 mm long. The total filter length was 27 mm. Cigarettes equipped with CellFx filter rods containing different filling materials were measured and compared to control in this biological evaluation Experimental Setup Saliva samples were taken from 38 subjects before and after cigarette smoking. Volunteers were recruited by OF Laboratories at Budapest University of Technology and Economics. Each volunteer reported between 8-9 am for saliva harvesting, cigarette smoking and saliva harvesting again. Each morning one trial cigarette was smoked and saliva collected from it. Each volunteer smoked 6 different cigarettes (differed by the filter) between Oct. 19-Nov. 20, 2015. Smokers were requested to report for smoking not taking any food or liquid that morning and not having their teeth brushed. Saliva was iced and carried for evaluation to KFKI laboratories.

HRP Peroxide-Benzidine Assay

Reagent 1: HRP (horse radish peroxidase) 9000 U/L, benzidine hydrochloride 233 μmol/L, sodium chloride 155 mmol/L, Reagent 2: Carbamide peroxide 0.36 mmol/L Solvent: Double-distilled water Instrument: UV-VIS spectrophotometer, temperature 25° C.

Freshly prepared reagents were used. Control was dissolved in 5 ml of double-distilled water. Saliva collected from volunteers were collected. Thereafter 20 μl of treated saliva solution was mixed with 1 ml of Reagent 1 and homogenized, and the reaction was started with 200 μl of Reagent 2. The change of absorbance at 620 nm was measured immediately after 3 minutes. The absorbance of saliva collected after smoking was compared with the absorbance of the non-reacted control saliva. The blank result was obtained without control saliva using 20 μl of double-distilled water. The results of the experiments are summarized in the Tables.

The study involved 38 volunteers according to the following:

| Male 29 people | | Female 9 people | |
|---|---|---|---|
| Smoker 26 | Non-smoker 3 | Smoker 4 | Non-smoker 5 |
| Age | | Age | |
| 18-24 years | 4 people | 18-24 years | 2 people |
| 25-40 years | 14 people | 25-40 years | 5 people |
| 41-59 years | 10 people | 41-59 years | 2 people |
| 60+ years | 1 person | 60+ years | 0 person |

Results

Figure 10:
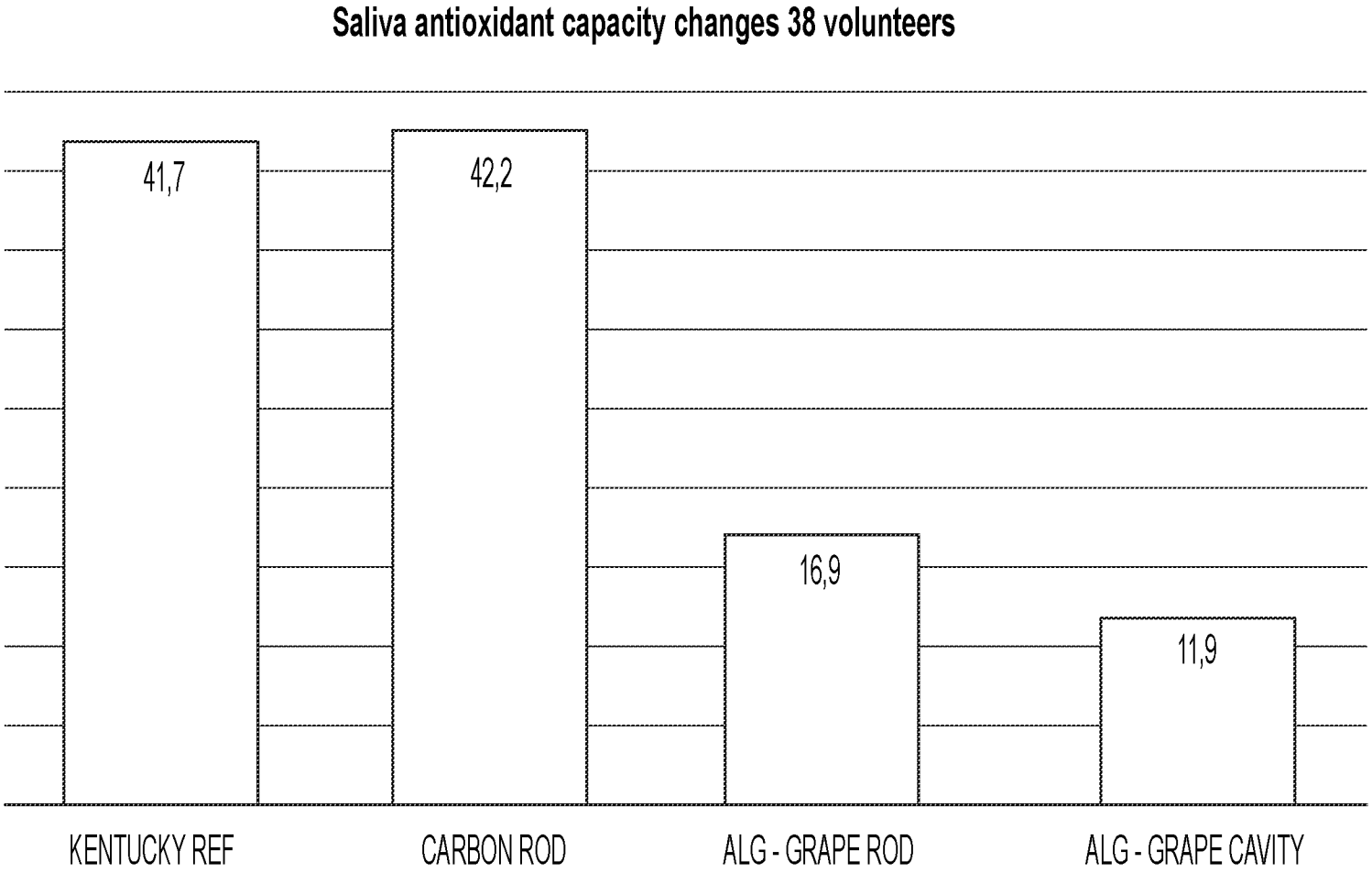
FIG. 10 is a diagram illustrating an antioxidant capacity of different filter compositions as measured by conducting an HRP peroxide-benzidine assay using saliva of test volunteers.
Figure 11:
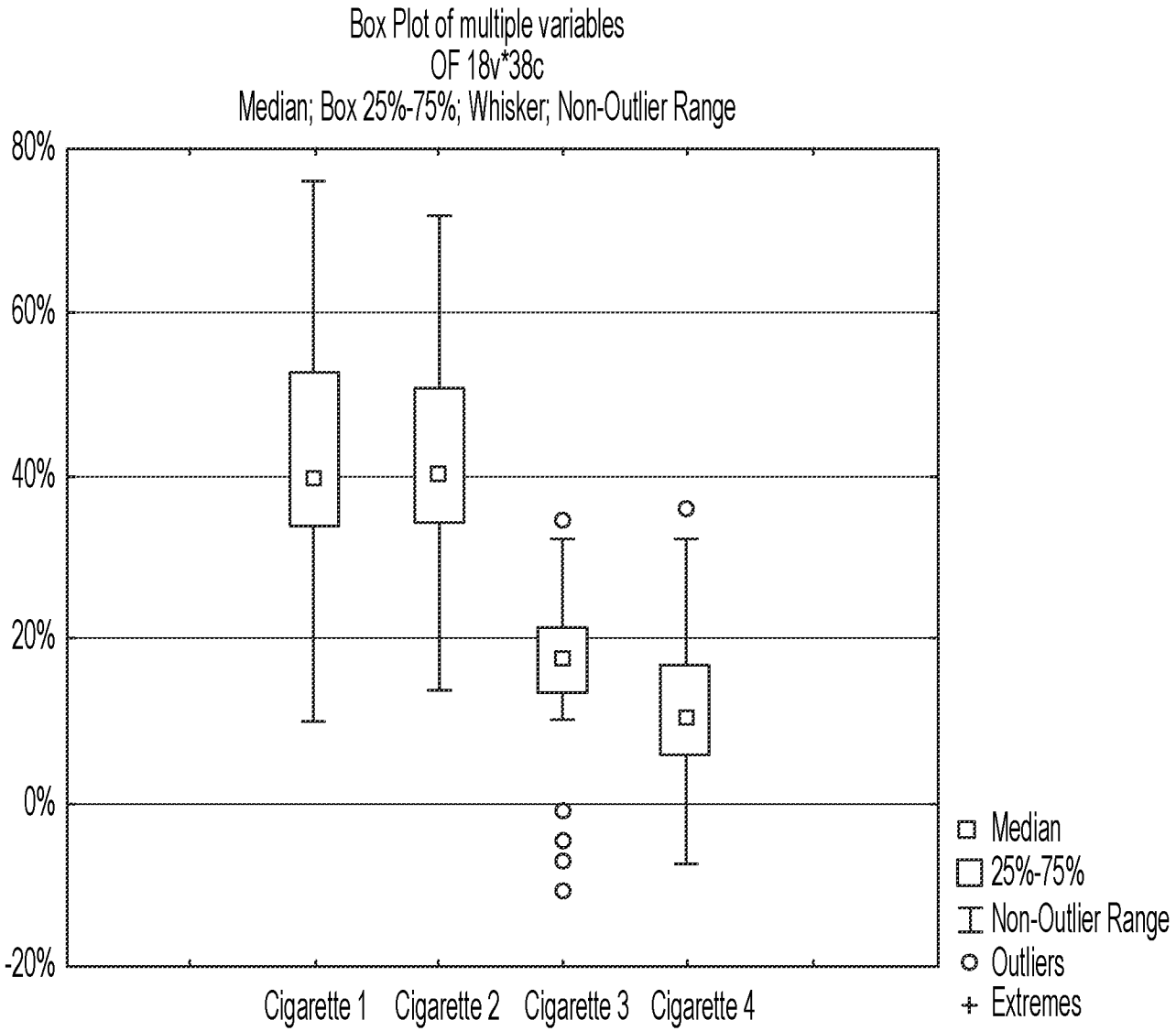
FIG. 11 is a diagram representing comparative results of the different filter compositions of FIG. 10 relating to a decrease in antioxidant status before and after cigarette smoking.

The results of the assay are shown in FIG. 10 and FIG. 11. wherein in FIG. 11. Cigarette 1=Kentucky Ref., Cigarette 2=Carbon Rod, Cigarette 3=Alg-Grape Rod, and Cigarette 4=Alg-Grape Cavity Summary of the Filters Used in the Experiment

| Saliva | Filter description | Abbreviation |
|---|---|---|
| Filter 1 | Kentucky Control Reference Cigarette | Kent. Ref. |
| Filter 2 | Celanese Rod 12 mm: Carbon | CelRod-12-C |
| Filter 3 | Celanese Rod 12 mm: 50% Alginite 8 50% Grape | CelRod-12-AG |
| Filter 4 | Cavity Alginite Grape 200 mg 50-50% | Cav-200-AG |

Results

| Change in antioxidant capacity | | | |
|---|---|---|---|
| KRC | CELROD-12-C | CELROD-12-AG | CAV-200-AG |
| 41.7 | 42.2 | 16.9 | 11.9 |

Conclusion

Our serum experiments confirmed that the filters of the invention, both in CellFx structures and in cavity, significantly improved the antioxidant capacity triggered by cigarette smoke. Considering that cigarette smoke enters the bloodstream seconds after it is inhaled, we think these data suggest that the filters of the present invention may contribute to healthier endothelium status in smokers. Our saliva experiments confirmed that the filters of the invention, both in CellFx structures and in cavity, significantly improve the antioxidant capacity in the mouth. We think this may contribute to healthier mucosa in smokers.

Example 3: Effect of Cigarette Filter Composition on the Smoke Induced Death of Endothelial and Epithelial Cells Cigarette smoke is a complex combination of chemicals characterized by high levels of oxidants. Increasing numbers of papers show that cigarette smoke induces the activation of pulmonary vascular endothelial cells, which is associated with the loss of endothelial barrier function. This loss is a hallmark of endothelial dysfunction. In this process cigarette smoke induced oxidative stress leads to endothelial cell damage, which enables the penetration of monocytes and activated macrophages. Damage to the endothelial barrier may even constitute an early element of lung injury in response to cigarette smoke exposure.

Cigarette smoke has also been shown to induce apoptosis of lung alveolar tissue via apoptosis of their epithelial cells, which contributes to the development of chronic lung disease such as emphysema. Although all cell types within the lung can be damaged by oxidative damage, epithelial cells are the major target for oxidant injury in that they constitute the first line of defense in the lung. Therefore, it is not surprising that epithelium injury by cigarette smoke is an important process in the pathogenesis of smoking-associated pulmonary diseases.

Numbers of studies have shown that highly reactive smoke constituents, volatile carcinogens, and reactive oxygen species (ROS) derived from cigarette smoke and cigarette smoke-damaged cells contribute to lung injury involving epithelial injury via cell death and further ROS production in activated epithelial cells. Therefore, protection of the epithelium from injury by cigarette smoke is considered to be critical for the management of numerous lung diseases associated with cigarette smoking. Our investigations showed that the composition of cigarette filters can be important in modifying the effect of cigarette smoke on induced death of epithelial cells, which represent the first cell line encounter with cigarette smoke, as well as damage to endothelial cells. Filters which could more effectively remove components of cigarette smoke that have the highest damaging potential on epithelial cells, as well as on endothelial cells, could reduce cigarette smoke-induced lung damage.

Materials, Subjects and Methods

Cigarettes used in the experiment were Kentucky Reference Cigarettes 3R4F, manufactured and assembled by the University of Kentucky, KY US. The cigarettes were provided to OptiFilter Zrt of Hungary by Celanese Corporation, Narrows, Va., US. Cigarette filters were assembled and trial cigarettes were produced by OptiFilter Zrt., CellFx filter rods were prepared and provided by Celanese Corporation. These contained different filtering materials, sometimes mixed. Additional acetate filter materials with different weave characteristics, thereby producing different pressure drop values, were manufactured and provided by Celanese Corporation. Kentucky Reference Cigarette 3R4F filters' 27 mm acetate parts (2.9/41,000) were removed and discarded. Filter rods, manufactured by Celanese's CellFx technology, contained different filling materials. One selected filter rod was introduced into the cigarette facing the burning end surface of the cigarette, an additional acetate part was selected and introduced to the filter, ensuring that the pressure drop (total resistance to draw) of the cigarette (filter ventilation closed) was the same as the KRC's pressure drop value (resistance to draw 170 mm $H_2O$+/−2%). Celanese rods were either 10 mm or 12 mm or 15 mm long. The acetate parts were by either 17 mm or 15 mm or 12 mm long. The total filter length was 27 mm. Cigarettes equipped with CellFx filter rods containing different filling materials were measured and compared to a control in this biological evaluation.

Endothelial cells play a critical role in the development of COPD, because the barrier function of endothelial cells are essential for healthy lung function; therefore, endothelial barrier function loss can contribute to leukocyte infiltration characteristic sign of lung diseases including COPD. Smoke induced cell death and inflammation in endothelial cells contribute to the development of COPD. Here we show that using different cigarette filter compositions we can modify smoke composition and can attenuate the damaging biological effects. FIG. 2 shows that smoke from Alginite/Zeolite/Carbon/Grape mix containing filters are less damaging to endothelial cells.

Epithelial cells are important components of lung tissue and have a significant role in lung cancer and COPD development. Using A549 lung epithelial cell line we showed that Alginite/Zeolite/Carbon/Grape mix-containing filters significantly reduce epithelial cell death thus possibly leading to decreased COPD risk. The results showed that the filters of the invention containing alginite/Zeolite/Carbon and Grape mix subtract some components of the smoke, and so cause less damage in lung epithelial and endothelial cells.

Protecting epithelial and endothelial cells can contribute to the attenuation of cigarette smoke-induced COPD and other respiratory disease development.

Preparation of the Cigarette Smoke Extract

Cigarette smoke extract preparation was performed as described before (Chen et al.; Chen Z H, Lam H C, Jin Y, Kim H P, Cao J, Lee S J, Ifedigbo E, Parameswaran H, Ryter S W, Choi A M. Autophagy protein microtubule-associated protein 1 light chain-3B (LC3B) activates extrinsic apoptosis during cigarette smoke-induced emphysema. Proc Natl Acad Sci USA. 2010 Nov. 2; 107(44):18880-5). For preparation of cigarette smoke extract, Kentucky 3R4F research reference filtered cigarettes (Tobacco Research Institute, University of Kentucky, Lexington, Ky.) were smoked by using a peristaltic pump (VWR International) using the different type of filters. Full smoke was harvested. Each cigarette was smoked in 4 min with a 15-mm butt remaining and was bubbled through 7.5 mL of cell growth medium via a silicone tube. This solution, regarded as 100%-strength cigarette smoke extract, was adjusted to a pH of 7.45 and used within 15 min after preparation. After each cigarette smoked the silicone tube was replaced to a new one.

HUVEC and A549 Cell Culture and Treatments.

HUVEC cells (Human Umbilical Vein Endothelial Cells) were obtained from Lonza (Anaheim, Calif., USA) Cat. no.: C2519A, and were cultured in endothelial growth medium (Lonza, Anaheim, Calif., USA) in a humidified atmosphere containing 5% CO2. For cell death analyses, $5\times10^3$/well HUVECs per well were seeded into 96-well plates in endothelial growth medium containing growth factors and 2% serum. Before each experiment, medium was replaced by fresh medium not containing growth factor and containing 1% serum and were incubated 10% smoke extract for 24 hours.

A549-human adenocarcinoma alveolar basal epithelial cells were from obtained from the European Collection of Authenticated Cell Cultures (ECACC) (Cell line: A549 Cat. no.: 86012804). A549 cells were cultured in DMEM medium containing 10% FCS in a humidified atmosphere containing 5% CO2. For cell death analyses, 5×103/well A549 cells were seeded into 96-well plates in DMEM medium containing 10% FCS and treated by 10% CS extract for 24 hours.

Cell Viability Assays

MTT Assay

Cells were seeded into 96-well plates at a starting density as given in the Figures and cultured overnight before the treatment with smoke. After the incubation period, the media were removed and replaced for 4 h with RPMI containing an appropriate amount of the MTT solution (3-(4,5-dimethylthiazol-2-yl)-2,5-diphenyltetrazolium bromide) (Chemicon Inc., El Segundo, Calif.) (14). The MTT reaction was terminated by adding HCl to the medium at a final concentration of 10 mM. The amount of water-insoluble blue formasan dye formed from MTT was proportional to the number of live cells and was determined with an Anthos Labtech 200 enzyme-linked immunosorbent assay reader at 550 nm wavelength after dissolving the blue formasan precipitate in 10% SDS. All experiments were run in at least 6 replicates and repeated three times.

Sulforhodamine B (SRB) Assay.

Cells were incubated in 96-well plates for 24 hours as described above. The culture medium was then discarded and the cells were fixed in situ by the addition of 100 μl of cold 10% (w/v) trichloroacetic acid and incubated for 30 min at 4° C. The supernatant was discarded, and the plates were washed five times with tap water and air dried for 24 hours. SRB solution (100 μl) at 0.4% (w/v) in 1% acetic acid was added, and plates were incubated for 20 min at room temperature. After staining, unbound dye was removed by washing five times with 1% acetic acid, and the plates were air dried. Bound stain was subsequently solubilized with (200 μl) 10 mM Tris (pH 10.5), and absorbance was read in a 96-well plate reader at 560 nm subtracting the background measurement at 600 nm using a Promega Glomax multimode detection system.

Results: Effect of Smoke on Lung Epithelial and Human Endothelial Cells

As noted, lung epithelial cells play critical role in the developing of chronic obstructive pulmonary disease (COPD). Changes in cigarette filter composition could potentially produce smoke that would reduce epithelial cell death as compared to smoke from a conventional cigarette. Therefore, we analyzed the role of different filter composition on smoke-induced epithelial cell death. FIG. 1 shows the effects of different filter compositions on A.0 cell death in A549 cells. The results shown in FIG. 1 were obtained using 10% smoke extract applied to the cell cultures. However, it is likely that results using 10% smoke concentration are more reasonable because increasing smoke concentration showed the proliferative effect of cigarette smoke. Data in FIG. 12. indicates that three filters of the invention containing Alginite/Zeolite/Grape Skin and Seed Grist (GSSG), alginite/GSSG and alginite/carbon filters significantly reduce the smoke induced death of A549 epithelial cells.

Figure 13:
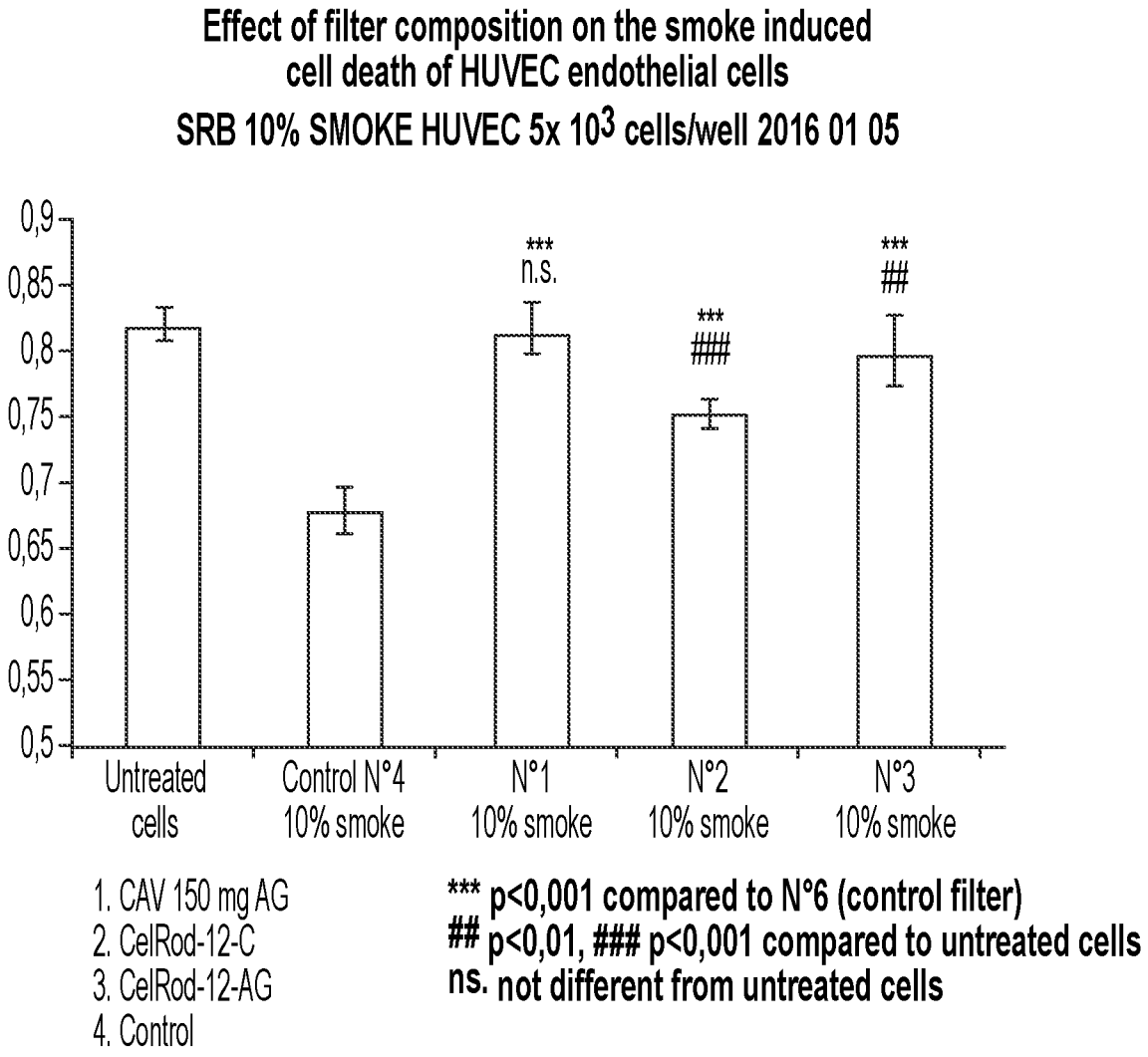
FIG. 13 is a diagram illustrating the effects of different filter compositions on smoke-induced cell death of Primary Human Umbilical Vein Endothelial Cells.

FIG. 13. shows the effects of different filter compositions on smoke-induced cell death of Primary Human Umbilical Vein Endothelial Cells (HUVEC). Here we used 4 cigarettes for each measurement for each filters and ran 6 replicates, and these data show that the filters of the invention containing various filtering materials in the filter significantly reduce smoke induced endothelial cell death.

These experiments showed that the cigarette filters of the invention significantly change the survival pattern of both epithelium and endothelium tissues exposed to cigarette smoke. This may be useful in combatting cigarette smoke triggered respiratory and cardiovascular diseases.

Example 4: Inflammatory Cytokine Production Following Cigarette Smoke Exposure in a Human 3D Pulmonary Tissue Model Cigarette smoking is a major factor associated with many complex diseases in the lung. Smoke exposure can induce inflammatory responses through inflammatory cytokine release. Macrophages play an important role in inflammatory response and are particular sources of interleukin-8 (IL-8) and interleukin-6 (IL-6). IL-8 is a multifunctional cytokine, mostly acting as a neutrophil chemo-attractant, while IL-6 is associated with impaired metabolism in COPD patients. As both cytokines play an important role in many lung diseases, such as COPD, pulmonary fibrosis or asthma; it seemed reasonable to investigate the effect of novel cigarette filters on the levels of these cytokines in our recently developed complex lung model system. The inflammatory processes in the lung are associated with production of several cytokines and neutrophil recruitment into the airways. IL-6 and IL-8 play crucial roles in the initiation and extension of inflammatory reactions. Cigarette smoke exposure can activate inflammation via enhancing pro-inflammatory cytokine secretion, leading to chronic inflammation. Cigarette smoke can also cause alterations at the organ level, such as airway destruction and loss of gas exchange surfaces, which can lead to impaired pulmonary functions. All of these negative effects can contribute to severe disease occurrence, including COPD or cancer. By using 3D tissue culture as the testing method, a combination of cells acting as a functional tissue unit can be evaluated as compared to single cells. Pulmonary tissue comprises epithelial cells that have a distinguished cellular architecture. These cells have specialized cell-cell contacts, a polarized morphology and are attached to an underlying basement membrane. The maintenance of these features is essential for normal function of the tissue, including proliferation, differentiation, survival and secretion. Cells naturally grow in a 3D environment. The spatial arrangement of cells within this environment affects how they interact with each other and their micro-environment. In turn, these intracellular signals affect morphology and a range of cellular functions. Therefore, when drug candidates or toxic agents are being tested using cell-based assays, the culture methods used should mimic the most natural in vivo representative form possible. The most natural, tissue-mimicking method of cell growth for drug discovery applications is, arguably, 3D. In vitro testing of cigarette smoke is complicated. A large number of cell lines have been evaluated, but all have their own limitations. IL-8 and IL-6 can be produced by several inflammatory and pulmonary cells, but investigation of one particular cell type may misrepresent the overall impact of smoke exposure. Cells growing in 2-dimensional cell cultures are routinely used in several types of pharmacological testing, but these in vitro circumstances are less relevant to the in vivo situation than is the case for a 3-dimensional model system. Three-dimensional lung cell cultures are more representative of what occurs in vivo, having an architecture and expression pattern closely matching the human lung. As the lung is a complex organ, it is necessary to investigate the biological processes in a complex model system, given that cell arrangement can affect the given response of a particular stimulus. Humeltis' 3D lung tissue combines multiple cell types, which represent the major cells of the airway tract.

Methods

Normal primary human small airway epithelial cells (SAEC) and normal human lung fibroblasts (NHLF) were purchased from Lonza. These cells were isolated from anonymous donors of different sex and ages. Human peripheral monocytes were isolated by the CD14 positive MicroBead isolation kit (Miltenyi Biotec). For 3D culturing SAEC and NHLF cells were mixed in 1:1 ratio (SN spheroids), and human monocytes were also mixed with these human primary cells (SNM spheroids). The cells were seeded onto a low attachment 96-well U-bottom plate. The spheroids were treated with cigarette smoke extracts (CSE) for 48 hours prior to measurement. Cigarettes used in the experiment were Kentucky Reference Cigarettes 3R4F, manufactured and assembled by the University of Kentucky, KY, US The cigarettes were provided to the OptiFilter Zrt of Hungary by Celanese Corporation, Narrows, Va. US. Cigarette filters were assembled, and trial cigarettes were produced by OptiFilter Zrt. CellFx filter rods were prepared and provided by Celanese Corporation. Additional acetate filter materials with different weave characteristics, thereby producing different pressure drop values, were manufactured and provided by Celanese Corporation. Kentucky Reference Cigarette (KRC) 3R4F filter's 27 mm acetate parts (2.9/41,000) were removed and discarded. Filter rods, manufactured by Celanese's CellFx technology and containing different filling materials were introduced facing the burning surface of the cigarette. An additional acetate part was selected and introduced to the filter, ensuring that the pressure drop (total resistance to draw) value of the cigarette (filter ventilation holes closed) was the same as the KRC's pressure drop value (resistance to draw 170 mmH2O+/−2%). Celanese rods were 12 mm long. The acetate parts were 15 mm long. The total filter length was 27 mm. A total of two different filters were made, and KRCs were equipped with them. Smoke from cigarettes equipped with filters of the present invention, CellFx filters containing different filling materials, were measured and compared to a control in the biological evaluation. Cigarette categorization was as follows:

Cigarette 1: Kentucky Reference Cigarette KRC

Cigarette 2: Filter Carbon mono rod CelRod-12-C

Cigarette 3: Filter Alginite/Grape rod CelRod-12-AG

CSE was prepared by bubbling the smoke from 2 cigarettes through 10 ml of cell culture medium at a constant airflow supplied by a Hydrotech Vacuum Pump (BioRad) for a total period of two minutes. The exposed medium was filtered under sterile conditions with a 0.22 um syringe filter. Light scattering of dissolved particulates showed no significant differences within the ranges of 320-350 nm. This solution was considered to be 100% E. The CSE was prepared within 30 minutes for each experiment. CSE (0.5%) was applied to the three-dimensional tissue cultures for 48 hours. After 48 hours the inflammatory cytokines produced by the 3D micro tissues were measured in the supernatant media by the BD Cytometric Bead Array Human Inflammatory Cytokine Kit (BD Biosciences). This kit provides quantitative measurement of IL-8 and IL-6 protein level in tissue culture supernatant. The method is based on fluorescent conjugated microbeads of known size and a detection reagent, which provides a proportional signal to the amount of bound cytokine. During 3 hours' incubation, capture microbeads form a complex with the cytokine from the supernatant along with the detection reagent. The fluorescent intensity was analyzed with a FACS Canto II flow cytometer (BD Immunocytometry Systems, Erembodegem, Belgium) with BD FACS DIVA software V6, and data were analyzed with FCS Express V3 software. The results represent the mean fluorescence intensity of the conjugated microbeads following the binding of IL-6 and IL-8.

Results

To investigate inflammatory cytokine production as a function of filter type, spheroids were treated with CSE from standard cigarettes and two different filter containing cigarettes for 48 hours. Data show that both IL-8 and IL-6 were reduced in macrophage containing aggregates following CSE treatment from number 3 filtered cigarettes, indicating reduced capability to initiate inflammatory reaction. The differences proved to be statistically significant for both cytokines.

Figure 14:
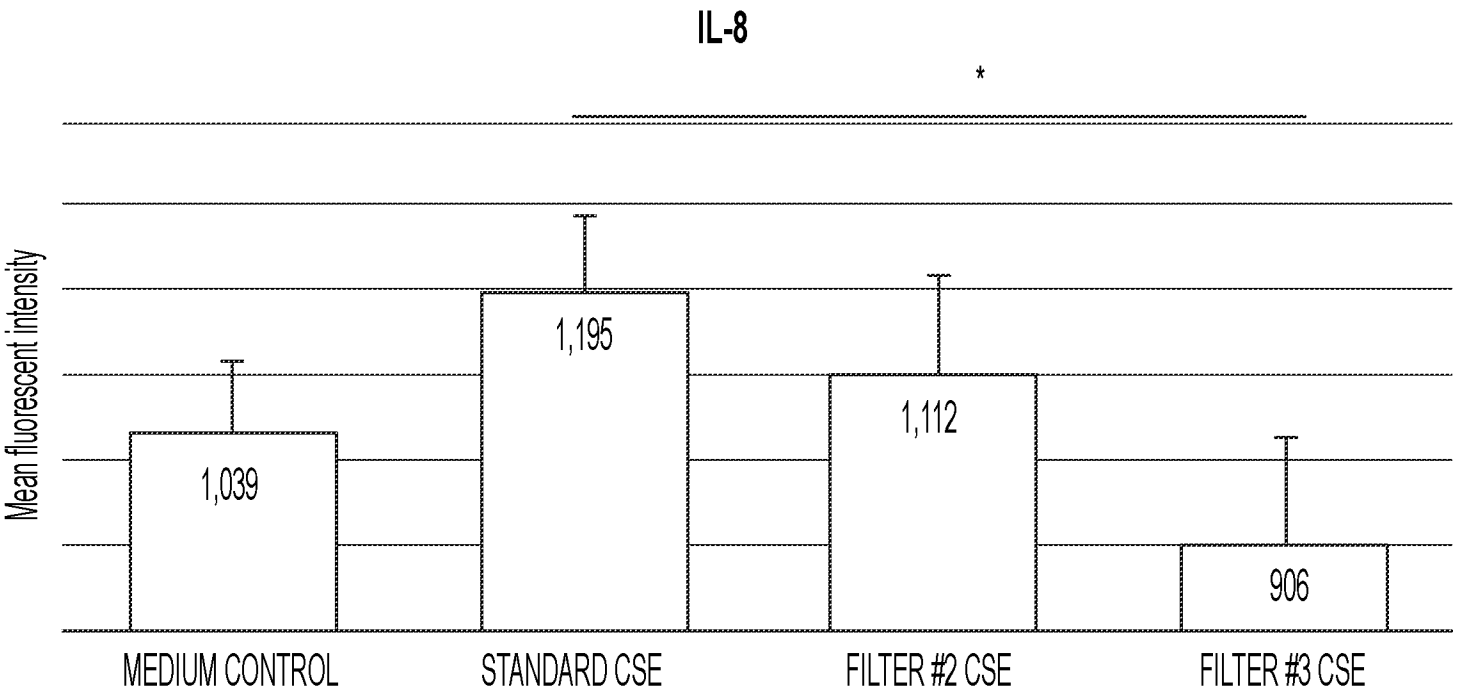
FIG. 14 is a diagram illustrating the fluorescent activity of Human IL-8 protein in supernatants of macrophage containing lung spheroids in 3 cell type aggregates 48 hours following CSE treatment, wherein the CSE was sourced from different filter compositions and conventional cigarettes.

FIG. 14. shows Human IL-8 protein in supernatants of macrophage containing lung spheroids after 48 hours in 3 cell type aggregates (SAEC, fibroblasts and macrophages).

Figure 15:
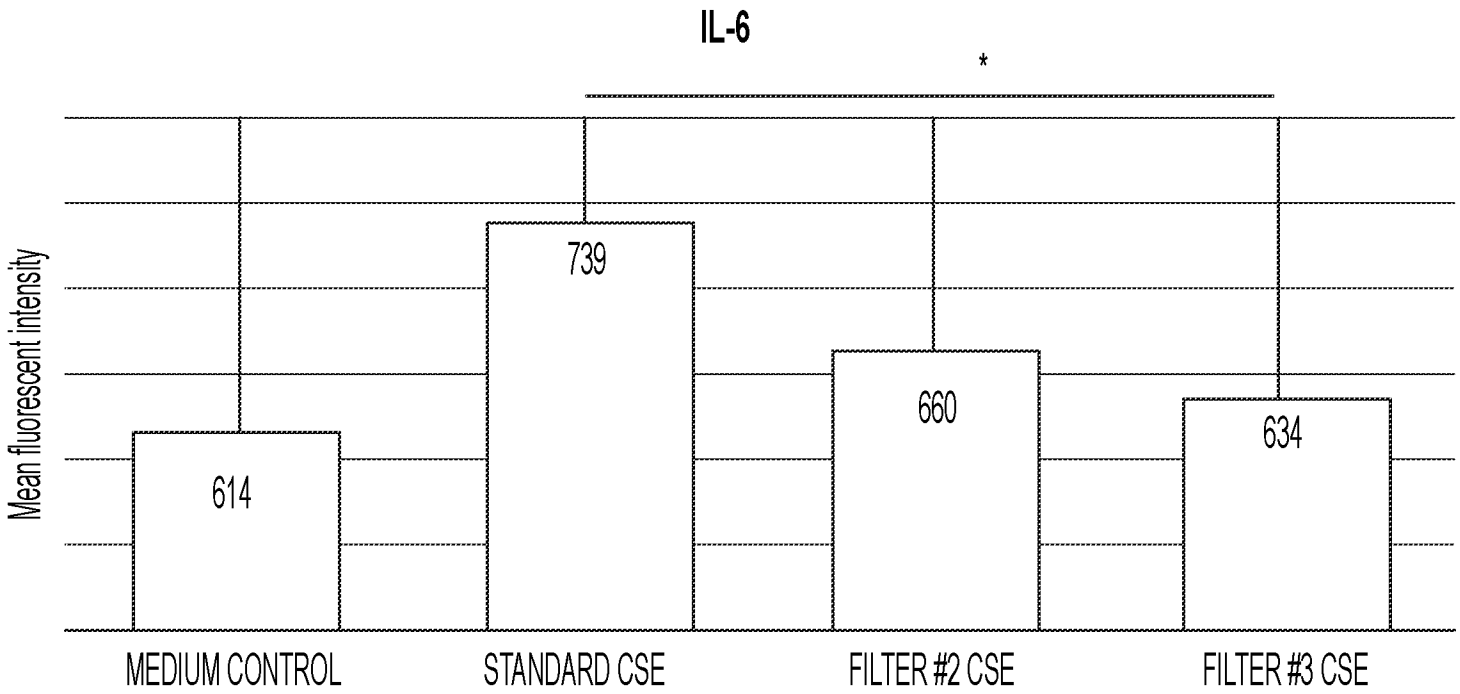
FIG. 15 is a diagram illustrating the fluorescent activity of Human IL-8 protein in supernatants of macrophage containing lung spheroids 48 hours following the CSE treatment of FIG. 14.

FIG. 15. shows Human IL-6 protein in supernatants of macrophage containing lung spheroids after 48 hours.

The decrease of cytokine levels was statistically significant only in the aggregates containing macrophages and only after 48 hours. In the aggregates formed by fibroblasts and primary epithelial cells only (no macrophages) the reduction of cytokine levels were not significant either after 24 or 48 hours. Cigarette number 3 decreased the levels of both cytokines to the level determined in control medium.

CONCLUSIONS

IL-6 and IL-8 play crucial roles in the initiation and propagation of inflammatory reactions. Cigarette smoke exposures can activate inflammation via causing tissue damage, thus enhancing pro-inflammatory cytokine secretion, which may lead to chronic inflammation. Arguably, 3D human tissue cultures show a close resemblance to the biochemical and pathological processes of human tissues in vivo. In this regard, it may be reasonable to assume that the statistically significant reduction of the investigated cytokines in the immunologically active aggregates (containing macrophages), when smoke is filtered by Filter #3 might be beneficial in the in vivo setting as well. The data are summarized as follows (SN stands for aggregates containing primary epithelial cells and fibroblasts, while SNM stands for aggregates containing epithelial cells, fibroblasts and macrophages):

| SN 24 H | | | | | | | | |
|---|---|---|---|---|---|---|---|---|
| | IL-8 | | | | IL-6 | | | |
| | ctrl 2x | standard 2x | Filter #2 2x | 3rd filter 2x | ctrl 2x | standard 2x | 2nd 2x | Filter #3 2x |
| 1st test | 886.62 | 657.85 | 888.18 | 879.57 | 363.82 | 230.33 | 301.38 | 308.87 |
| 2nd test | 814.29 | 1049.64 | 900.68 | 862.21 | 1487.67 | 1739.00 | 1504.89 | 1652.68 |
| 3rd test | 445.43 | 429.94 | 432.01 | 419.63 | 325.13 | 295.79 | 354.72 | 393.75 |
| 4th test | 804.46 | 944.75 | 881.06 | 916.04 | 1177.79 | 1449.24 | 1406.54 | 1413.61 |
| Mean | 737.70 | 770.55 | 775.48 | 769.36 | 838.60 | 928.59 | 891.88 | 942.23 |

-continued

| | | | | | | | | |
|---|---|---|---|---|---|---|---|---|
| STDEV | 298.26 | 281.04 | 229.13 | 234.23 | 584.64 | 778.00 | 652.66 | 690.15 |
| SE | 99.13 | 140.52 | 114.56 | 117.12 | 292.32 | 389.30 | 326.33 | 345.07 |
| N | 4 | 4 | 4 | 4 | 4 | 4 | 4 | 4 |
| p-value | | | | | | | | |
| SNM 48 h | | | | | | | | |
| 1st test | 1038.28 | 1102.19 | 1239.07 | 702.67 | 237.54 | 245.87 | 257.64 | 150.80 |
| 2nd test | 883.37 | 1043.70 | 963.84 | 1076.88 | 1196.19 | 1263.68 | 1115.51 | 1244.01 |
| 3rd test | 1266.76 | 1466.50 | 1346.42 | 1151.40 | 376.76 | 561.09 | 458.94 | 429.92 |
| 4th test | 966.41 | 1169.47 | 897.17 | 692.11 | 545.31 | 884.26 | 808.28 | 709.40 |
| Mean | 1038.71 | 1195.47 | 1111.63 | 905.77 | 614.20 | 738.73 | 660.09 | 633.53 |
| STDEV | 164.69 | 187.86 | 215.41 | 242.56 | 423.48 | 436.36 | 379.38 | 466.52 |
| SE | 82.34 | 93.93 | 107.70 | 121.28 | 211.74 | 218.18 | 189.69 | 233.26 |
| N | 4 | 4 | 4 | 4 | 4 | 4 | 4 | 4 |
| p-value | | | | 0.04 | | | | 0.02 |

SUMMARY

The above Examples clearly demonstrate that alginite is especially effective when used in cigarette filters alone or in combination with other known components as discussed above. As unexpected and novel features of the invention that the use of alginite in cigarette filters resulted in significantly less reactive oxygen species (ROS) in saliva, significantly less ROS formation in blood serum, less endothelial damage, less lung epithelium damage, significantly higher glutathione level, less damage in lung tissues and less inflammation in lung tissues.

The in vitro biological tests that were selected were well chosen in that they have a clear and well-established link to the in vivo biological pathways that have been documented for the causation of the major smoking-related diseases. Further, in every case the filters of the invention were shown to produce gas phase smoke that was far less damaging in the in vitro tests than the smoke produced from Kentucky reference filter. These results therefore provide compelling evidence that cigarettes equipped with these filters may well decrease the current health effects of cigarette smoking.

The Examples illustrated further that alginite even alone has significantly improved filtering characteristics over the known filtering materials, and that alginite and the filtering materials belonging to the prior art act synergistically. Therefore, although not all combinations containing mentioned in the examples, it is apparent for a person skilled in the art any combination of alginite and known filtering materials in the particular technical field will have the same properties. Therefore, the present application expressly encompasses all such combinations.

What is claimed is:

1. A method for filtering cigarette smoke, the method comprising filtering cigarette smoke with alginite.

2. The method of claim 1, further comprising disposing alginite in a cigarette filter.

3. The method of claim 2, further comprising disposing a first additional substance configured to reduce the harmful effects of cigarette smoke in the cigarette filter.

4. The method of claim 3, wherein the first additional substance is selected from a group consisting of activated carbon and grape components.

5. The method of claim 4, wherein the first additional substance is a grape component.

6. The method of claim 5, wherein the grape component is selected from a group consisting of grape pip and skin grist.

7. A method for manufacturing cigarette filters, the method comprising disposing alginite in a cigarette filter.

8. A method for reducing the risk of damage from smoke in a human, the method comprising filtering smoke with alginite.

9. The method of claim 8, wherein the alginite is disposed in a filter of a personal smoking device.

10. The method of claim 8, wherein reducing the risk of damage from smoke includes reducing ROS in saliva.

11. The method of claim 8, wherein reducing the risk of damage from smoke includes reducing ROS in serum.

12. The method of claim 8, wherein reducing the risk of damage from smoke includes reducing damage to epithelial cells.

13. The method of claim 8, wherein reducing the risk of damage from smoke includes reducing damage to endothelial cells.

14. The method of claim 8, wherein reducing the risk of damage from smoke includes raising glutathione levels.

15. The method of claim 8, wherein reducing the risk of damage from smoke includes reducing damage in lung tissue.

16. The method of claim 8, wherein reducing the risk of damage from smoke includes reducing inflammation in lung tissue.

17. A personal smoking device, comprising: a filter comprising alginite.

* * * * *